US012751481B2

(12) United States Patent
Lee et al.

(10) Patent No.: US 12,751,481 B2
(45) Date of Patent: Oct. 6, 2026

(54) SMOKING ARTICLE INCLUDING NOVEL FLAVORING AGENT

(71) Applicant: KT&G CORPORATION, Daejeon (KR)

(72) Inventors: Changgook Lee, Daejeon (KR); Ick Joong Kim, Daejeon (KR); In Beom Song, Daejeon (KR); Ji Seob Woo, Daejeon (KR); Kyung Bin Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 696 days.

(21) Appl. No.: 18/035,559

(22) PCT Filed: Nov. 17, 2022

(86) PCT No.: PCT/KR2022/018224
§ 371 (c)(1),
(2) Date: May 5, 2023

(87) PCT Pub. No.: WO2023/090904
PCT Pub. Date: May 25, 2023

(65) Prior Publication Data

US 2024/0349776 A1 Oct. 24, 2024

(30) Foreign Application Priority Data

Nov. 18, 2021 (KR) ..... 10-2021-0159657
May 16, 2022 (KR) ..... 10-2022-0059745

(51) Int. Cl.
*A24B 15/32* (2006.01)
*A24B 15/40* (2006.01)
*A24D 1/02* (2006.01)

(52) U.S. Cl.
CPC ..... *A24B 15/32* (2013.01); *A24B 15/40* (2013.01); *A24D 1/02* (2013.01)

(58) Field of Classification Search
None
See application file for complete search history.

(56) References Cited

U.S. PATENT DOCUMENTS 332,428 A 12/1885 Parsons, Jr.
5,139,034 A * 8/1992 Chan ..... A24B 15/403 131/277

(Continued)

FOREIGN PATENT DOCUMENTS

CN 102311464 A 1/2012
CN 102311465 A 1/2012

(Continued)

OTHER PUBLICATIONS

Extended European Search Report dated Apr. 2, 2025 in application No. 22879672.8.

(Continued)

*Primary Examiner* — Michael J Felton
(74) *Attorney, Agent, or Firm* — Sughrue Mion, PLLC

(57) ABSTRACT

The present disclosure relates to a smoking article including a novel flavoring agent, and more particularly, to a smoking article including a flavoring agent that is a novel compound which includes a flavoring compound-derived moiety in a basic skeleton, and in which a lactone compound, a sugar compound, and a flavoring compound are decomposed during thermal decomposition.

17 Claims, 21 Drawing Sheets

(56) References Cited

U.S. PATENT DOCUMENTS

| | | | |
|---|---|---|---|
| 5,147,463 | A | 9/1992 | Eilerman et al. |
| 5,703,123 | A | 12/1997 | Pelzer et al. |
| 6,557,561 | B1 | 5/2003 | Miyauchi et al. |
| 2002/0193269 | A1 | 12/2002 | Anderson et al. |
| 2011/0083679 | A1 | 4/2011 | Liu et al. |

FOREIGN PATENT DOCUMENTS

| | | | |
|---|---|---|---|
| CN | 116648152 | A | 8/2023 |
| JP | 2023-554578 | A | 12/2023 |
| KR | 10-2011-0106221 | A | 9/2011 |
| RU | 2 669 151 | C1 | 10/2018 |
| TW | 201429415 | A | 8/2014 |
| WO | 92/10107 | A1 | 6/1992 |
| WO | 2011/042210 | A2 | 4/2011 |

OTHER PUBLICATIONS

Communication issued Mar. 4, 2024 in Russian Application No. 2023112591.

Communication issued Aug. 8, 2025 in Chinese Application No. 202280008282.2.

Huang Zhixi, et al., "A Review on the Recent Progress of Tobacco Flavorants Research", Flavour Fragrance Cosmetics, Apr. 2003, No. 2, pp. 25-29 (6 pages total).

Zhang Ya-Wen, et al., "Synthesis of Tobacco Flavor Precursors and Their Application in Cigarette", A Thesis Submitted to Southeast University for the Academic Degree of Master of Engineering, School of Chemistry and Chemical Engineering Southeast University, May 2018, pp. 1-80 (88 pages total).

Communication dated Aug. 6, 2024 issued by the Japanese Patent Office in application No. 2023-521971.

International Search Report for PCT/KR2022/018224 dated, Feb. 27, 2023 (PCT/ISA/210).

Communication dated Dec. 10, 2025 in Chinese Application No. 202280008282.2.

* cited by examiner

| Example 4 | No. | Flavoring agent application amount (g of sample/100 kg of cut tobacco) | Flavoring agent application site (A) |
|---|---|---|---|
| Sample 1 | 1 | 7.4 |  |
| | 2 | 30.0 |  |
| | 3 | 30.0 |  |
| Sample 2 | 1 | 7.4 |  |
| | 2 | 30.0 |  |
| | 3 | 30.0 |  |
| Sample 3 | 1 | 7.4 |  |
| | 2 | 30.0 |  |
| | 3 | 30.0 |  |
| Sample 4 | 1 | 7.4 |  |
| | 2 | 30.0 |  |
| | 3 | 30.0 |  |

| Example 5 | No. | Amount of γ-undecalactone expressed during thermal decomposition g/100 kg of cut tobacco) | Flavoring agent application site (A) |
|---|---|---|---|
| Sample 5 | 1 | 2.56g |   |
| | 2 | 12.51g |   |

| Example 6 | No. | Cigarette paper/filter part application site (A) (cigarette paper) | (2.56 g of γ-undecalactone which is expressed during thermal decomposition/100 kg of cut tobacco) |
|---|---|---|---|
| Sample 6 | 1 | 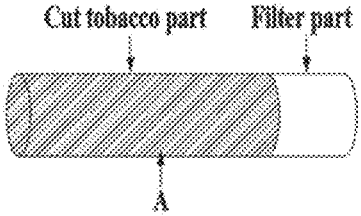 | Application of the entirety of cigarette paper |
| | 2 | 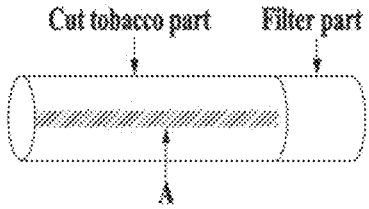 | Applied as a line (transverse) along the cigarette load |
| | 3 | 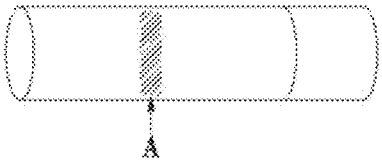 | Applied as a band (axis) to the cigarette rod (center region), which changes the atmosphere of sidestream smoke during smoking (when smoking in the middle) |
| | 4 | 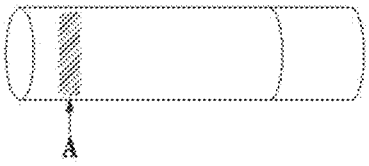 | Applied as a band (axis) to the cigarette rod (lighting starting part) to change the sidestream smoke atmosphere at the beginning of smoking |
| | 5 | 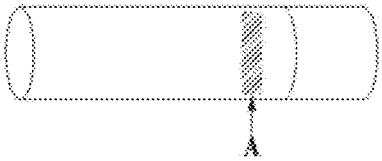 | Applied as a band (axis) to the cigarette rod (close to the filter part) At the last puff, the sidestream smoke atmosphere changes |

FIG. 21

SMOKING ARTICLE INCLUDING NOVEL FLAVORING AGENT

TECHNICAL FIELD

The following description relates to a smoking article including a novel flavoring agent from which flavor ingredients are released by heat.

BACKGROUND ART

The taste may be further improved by adding flavoring agents to smoking articles. Smoking articles are manufactured so that smoke or aerosol generated in the smoking articles moves from upstream to downstream and is delivered to the smoker to feel the smoking satisfaction. There are various factors that determine smoking satisfaction, but the most important is the cigarette taste that the smoker feels. A smoker wants to enjoy a variety of cigarette tastes in one smoking article, and cigarette manufacturers add flavoring substances (e.g., flavoring agents) to satisfy such a desire of the smoker so that the smoker may feel various flavors or savors.

Existing flavoring agents are highly likely to decompose the chemical structure at room temperature when the smoking medium is stored for a long period of time, and it is difficult to express sufficient flavor capable of enhancing the cigarette taste during smoking due to volatilization of flavor ingredients, or persistence of flavor is weak or cigarette taste is changed as smoking time elapses. Accordingly, it is necessary to express a flavoring agent capable of increasing smoking satisfaction during smoking. In addition, when tobacco is manufactured and/or stored, it is frequently the case that the flavoring agent is decomposed or the flavor ingredients are volatilized and released to be disappeared. Therefore, it is necessary to express a flavoring agent capable of preventing or delaying the release of volatile flavors to increase storage lifetime and enabling sufficient flavor expression when used by a user (e.g., during smoking) and a smoking article to which the same is applied.

DISCLOSURE OF THE INVENTION

Technical Goals

Existing compounds having a flavoring agent function have low chemical structural stability at room temperature (rt) or a temperature close thereto so that structural transformation or decomposition may occur, and thus flavor ingredients may volatilize. In order to solve this problem, an objective to be achieved by the present disclosure is to provide a smoking article including a novel flavoring agent from which flavor ingredients are released by thermal decomposition when heat is applied.

However, the problem to be solved by the present disclosure is not limited to those mentioned above, and other problems not mentioned will be clearly understood by those skilled in the art from the description below.

Technical Solutions

According to one embodiment of the present disclosure, the present disclosure relates to a smoking article including a flavoring agent which is a compound represented by Formula 1 below.

[Formula 1]

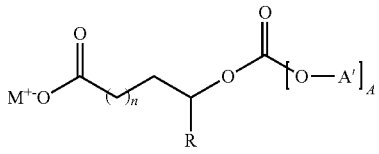

(In Formula 1,
n is an integer of 1 or 2,
M is selected from alkali metals and transition metals,
R is a straight-chain or branched-chain alkyl group having 1 to 30 carbon atoms, and
moiety A is a moiety derived from a flavoring compound having at least one of an aromatic ring, an aliphatic ring, and an aliphatic chain which have a hydroxyl group, in which the hydroxyl group participates in a carbonate linking group

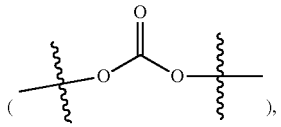

and A' corresponds to a flavoring compound except for the hydroxyl group.)

Effects

According to one embodiment of the present disclosure, since the smoking article including a flavoring agent according to the present disclosure expresses flavor ingredients during smoking to relieve the acrid smell of sidestream smoke, and release the flavor ingredients during thermal decomposition by heating, the taste of cigarette can be improved, and the taste of cigarette can be constantly maintained.

According to one embodiment of the present disclosure, the smoking article including a flavoring agent according to the present disclosure can control and improve the cigarette taste, atmosphere, etc. by variously utilizing and/or modifying the application method, application site, etc.

BRIEF DESCRIPTION OF DRAWINGS

FIG. 21 is a diagram illustrating a table showing the effects of improving sidestream smoke in synthetic flavoring cigarette products depending on the application sites in an example according to one embodiment of the present disclosure.

BEST MODE FOR CARRYING OUT THE INVENTION

Figure 1:
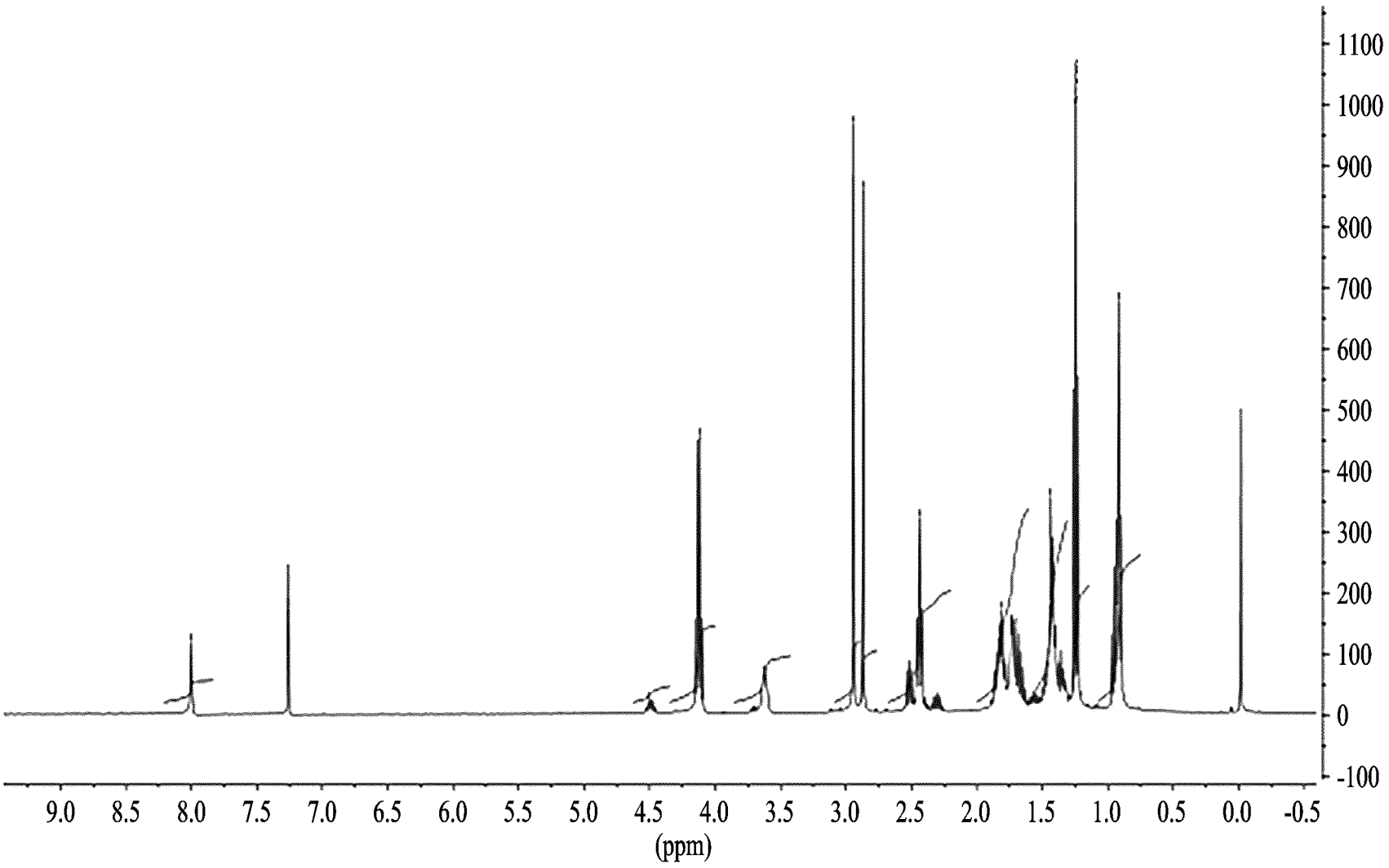
FIG. 1 is a diagram illustrating the results of NMR analysis of ethyl 4-hydroxyheptanoate (2a) prepared in an example according to one embodiment of the present disclosure.
Figure 2:
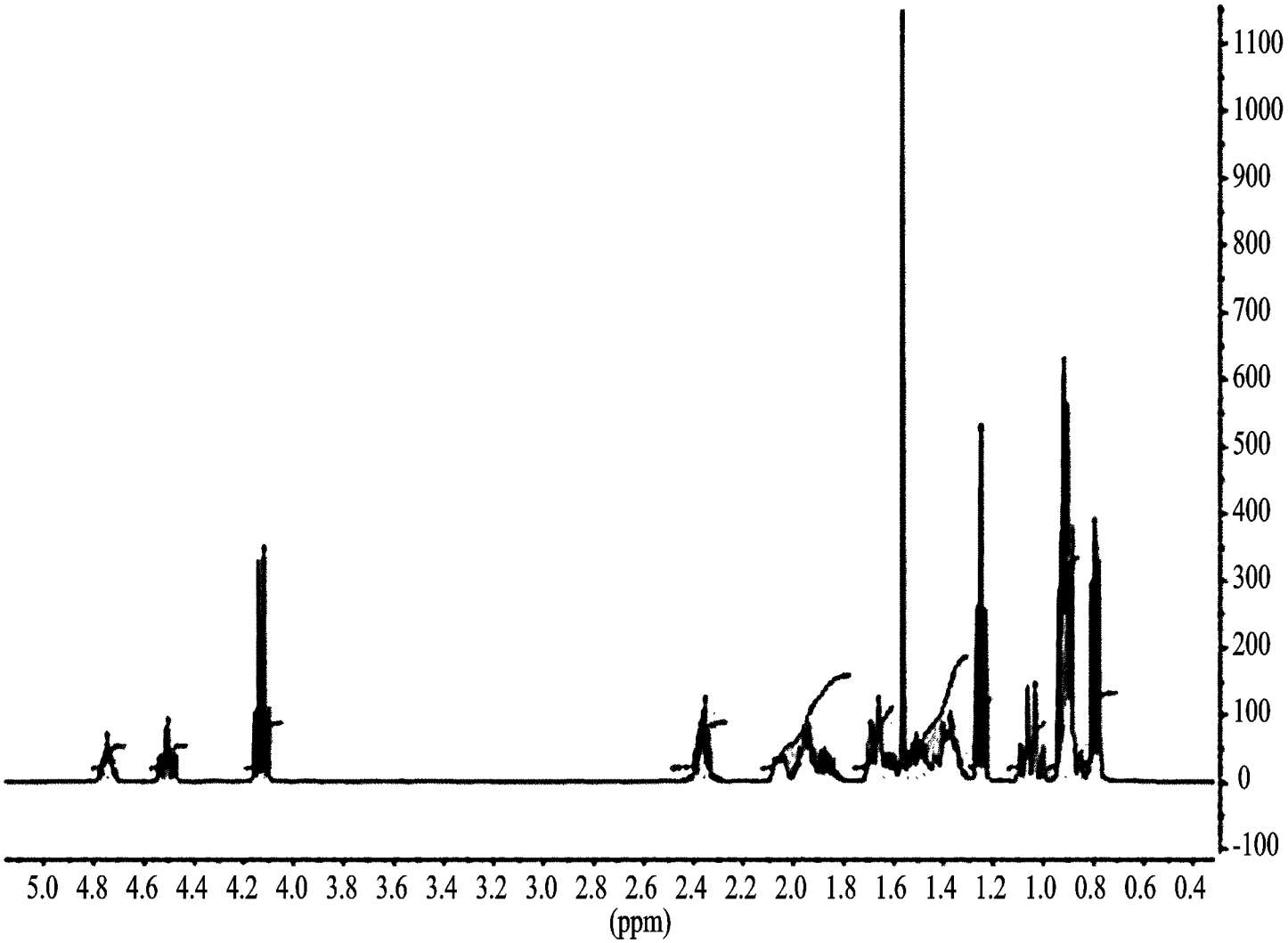
FIG. 2 is a diagram illustrating the results of NMR analysis of ethyl 4-(menthylcarbonyloxy) heptanoate (3a) prepared in an example according to one embodiment of the present disclosure.
Figure 3:
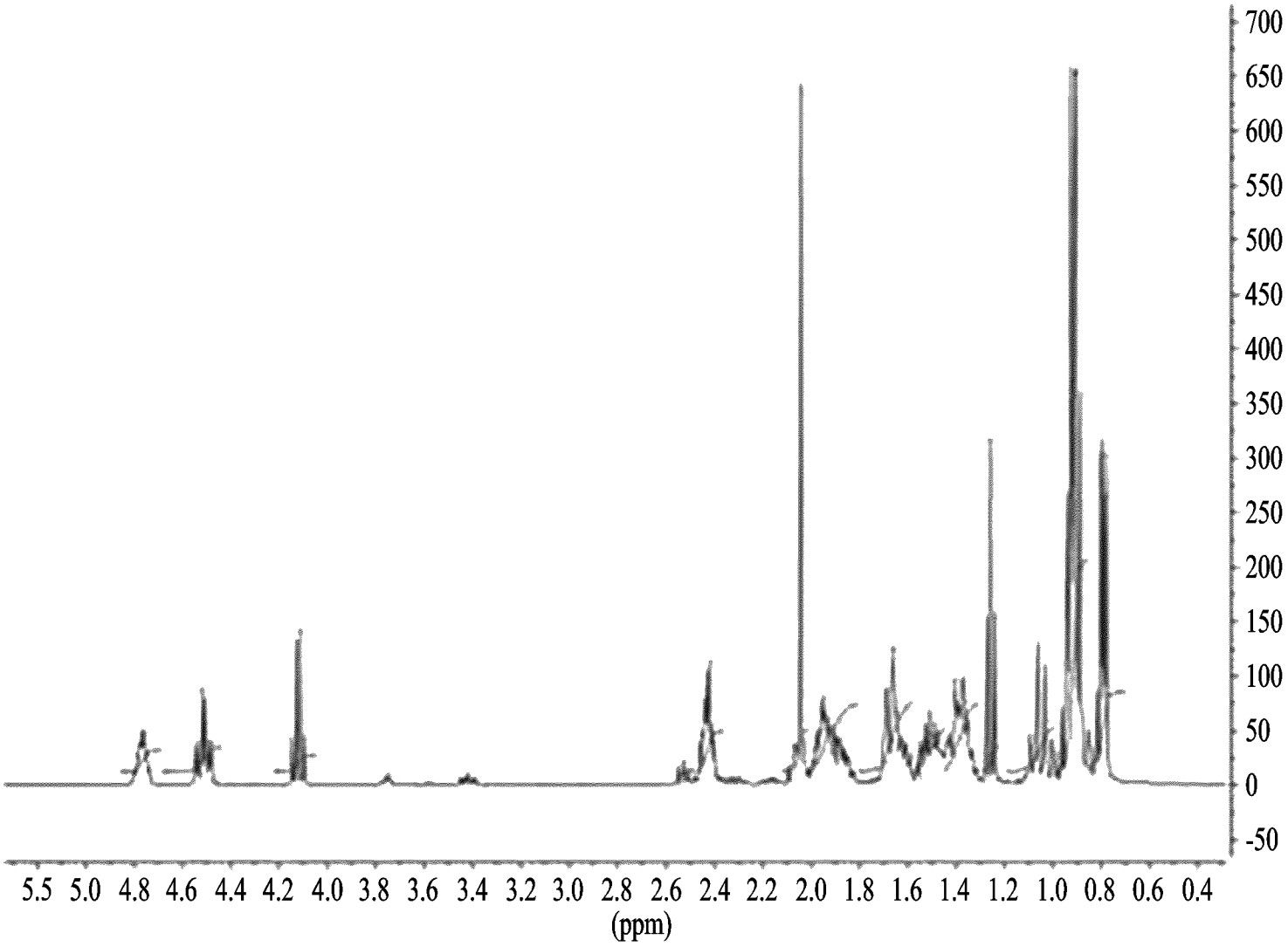
FIG. 3 is a diagram illustrating the results of NMR analysis of 4-(menthylcarbonyloxy) heptanoic acid (4a) prepared in an example according to one embodiment of the present disclosure.
Figure 4:
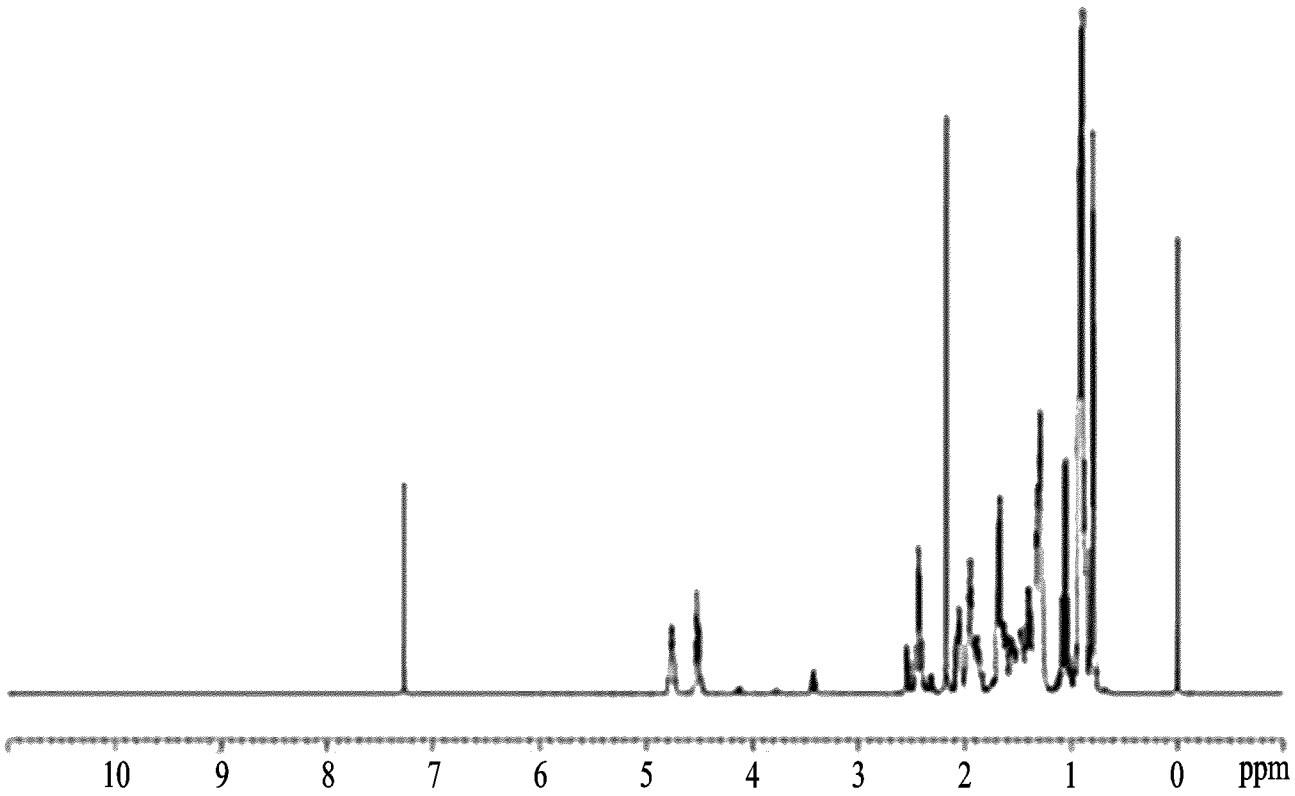
FIG. 4 is a diagram illustrating the results of NMR analysis of 4-(menthylcarbonyloxy) nonanoic acid (4b) prepared in an example according to one embodiment of the present disclosure.
Figure 5:
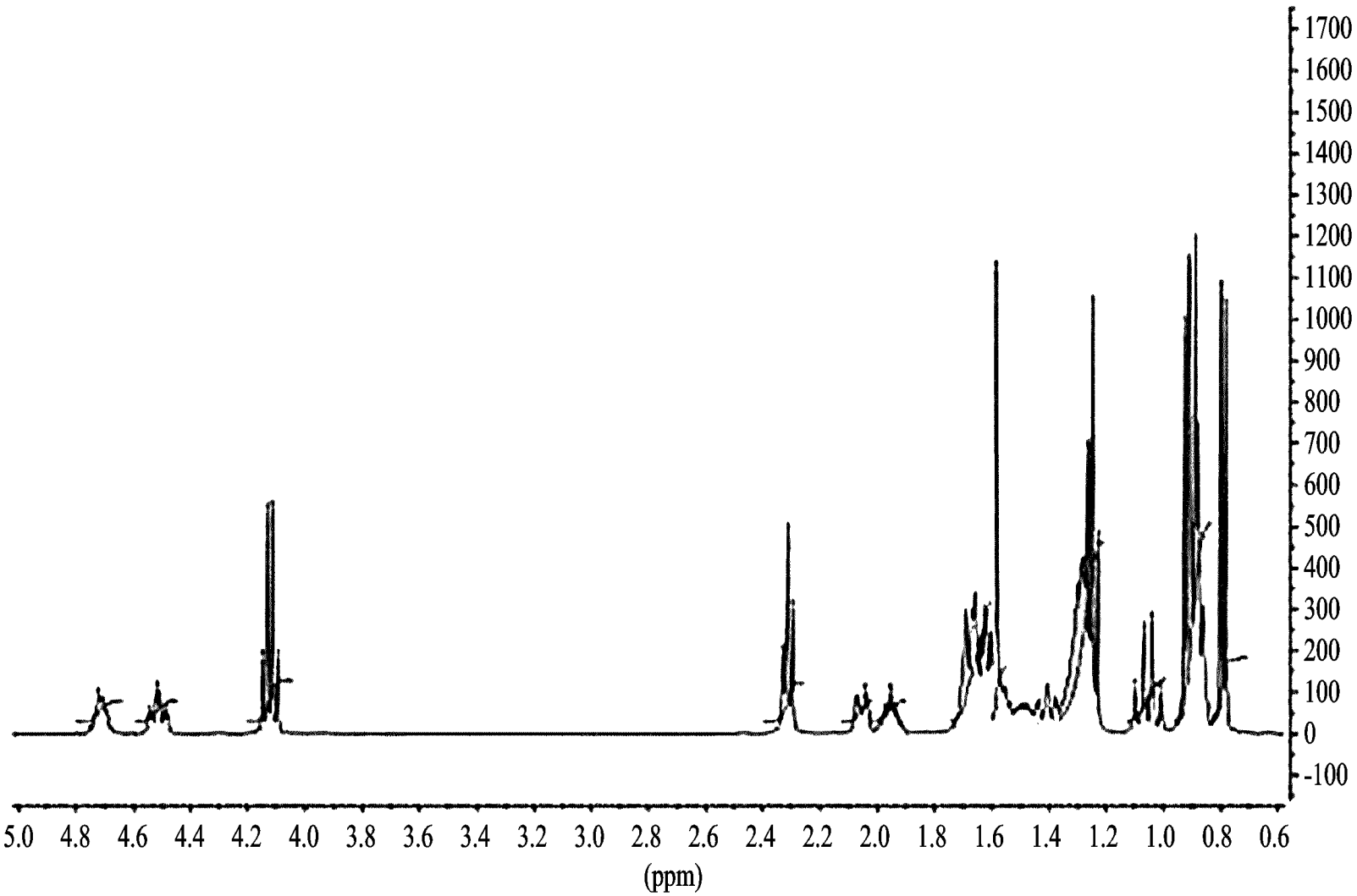
FIG. 5 is a diagram illustrating the results of NMR analysis of 5-(menthylcarbonyloxy)decanoate (3c) prepared in an example according to one embodiment of the present disclosure.
Figure 6:
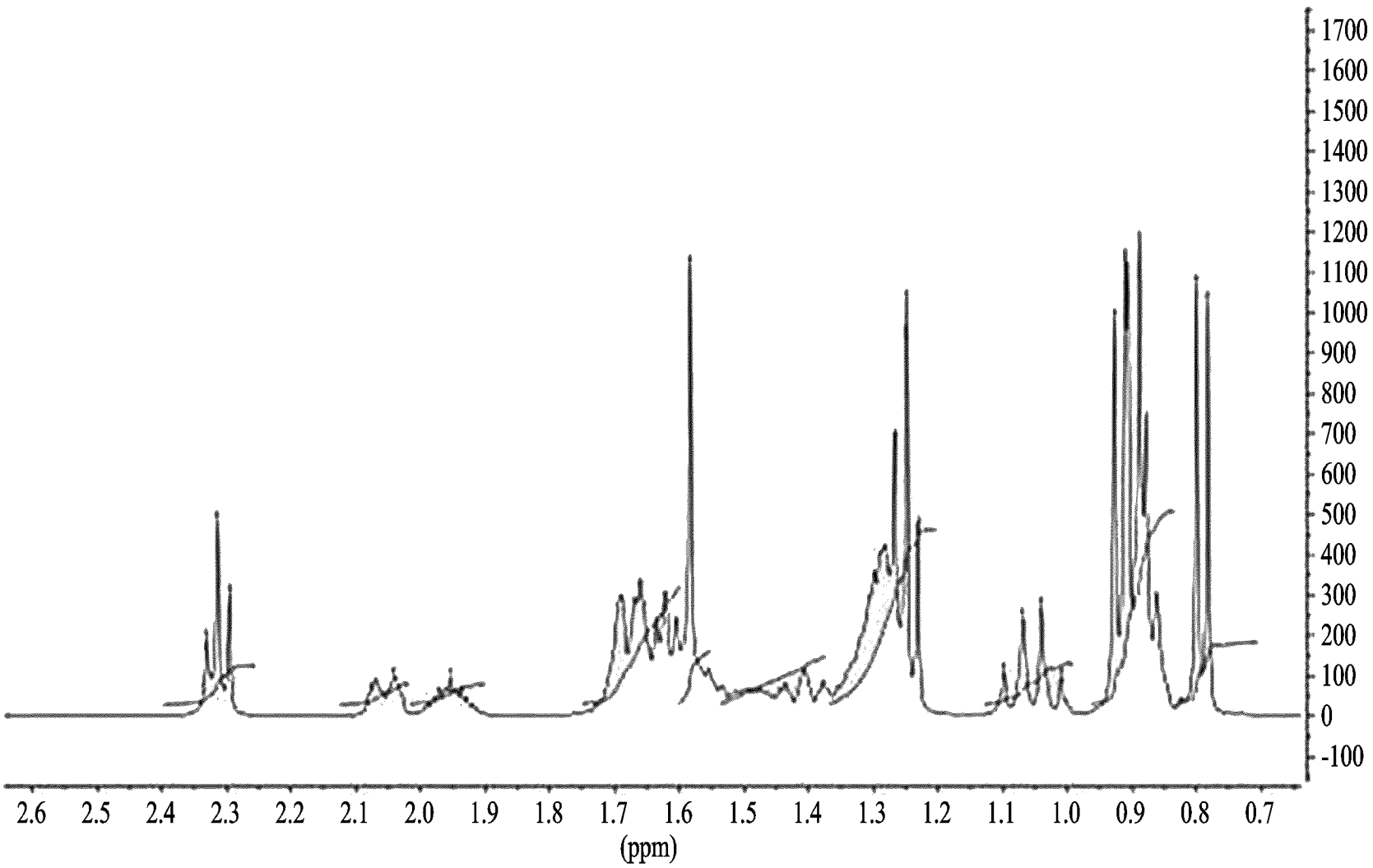
FIG. 6 is a diagram illustrating the results of NMR analysis of 5-(menthylcarbonyloxy)decanoate (3c) prepared in an example according to one embodiment of the present disclosure.
Figure 7:
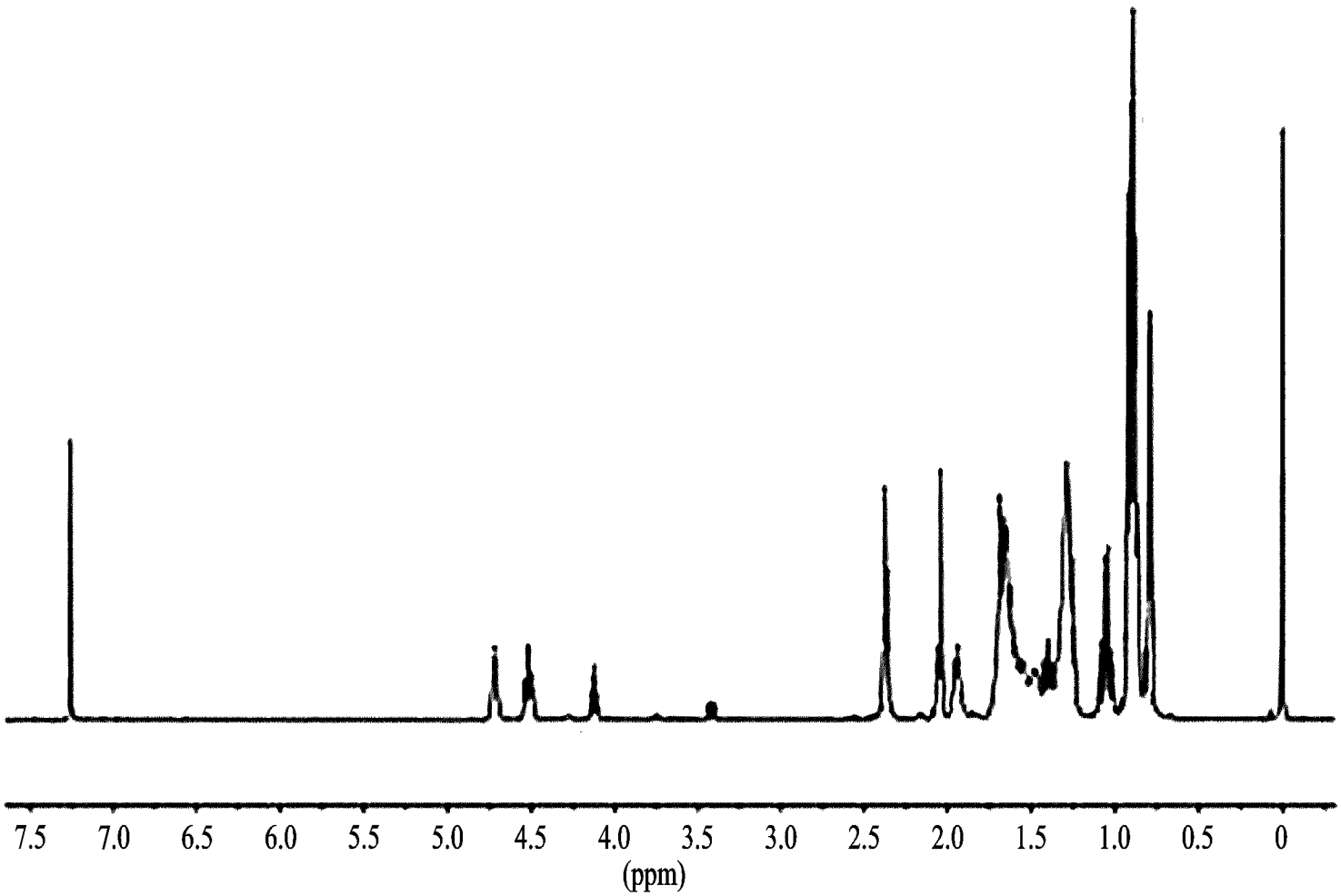
FIG. 7 is a diagram illustrating the results of NMR analysis of 5-(menthylcarbonyloxy) decanoic acid (4c) prepared in an example according to one embodiment of the present disclosure.
Figure 8:
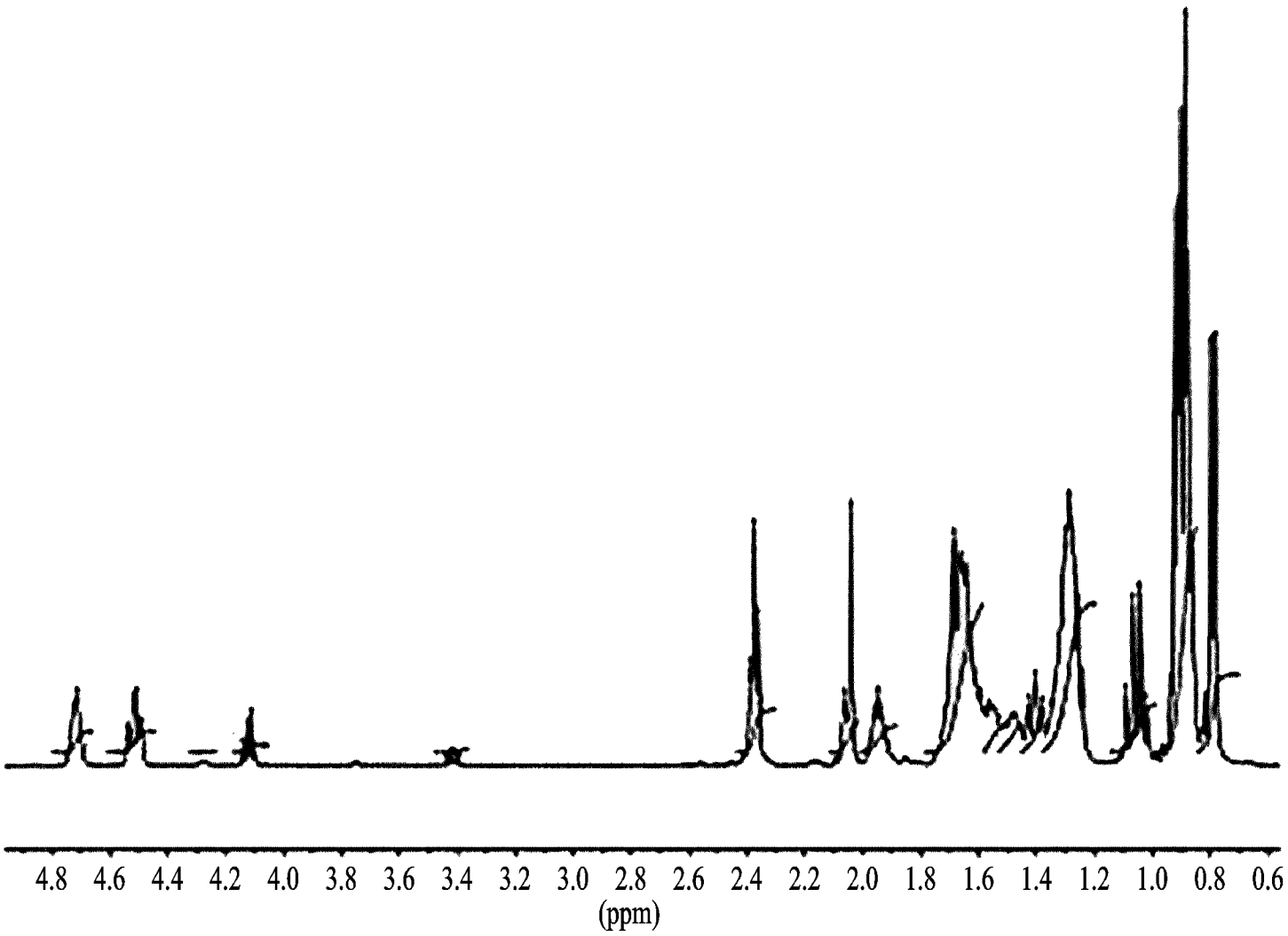
FIG. 8 is a diagram illustrating the results of NMR analysis of 5-(menthylcarbonyloxy) decanoic acid (4c) prepared in an example according to one embodiment of the present disclosure.
Figure 9:
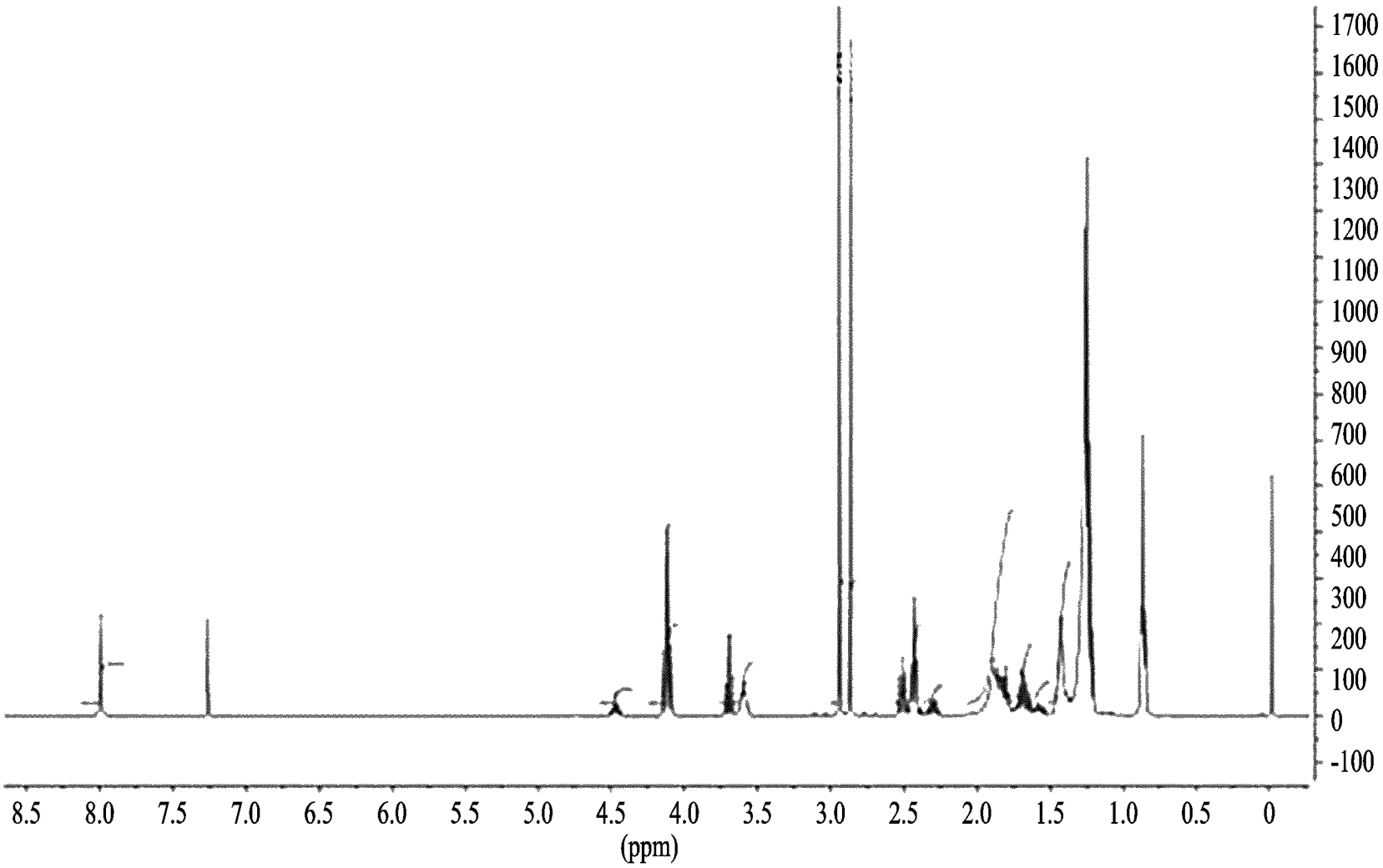
FIG. 9 is a diagram illustrating the results of NMR analysis of ethyl 4-hydroxyundecanoate (2d) prepared in an example according to one embodiment of the present disclosure.
Figure 10:
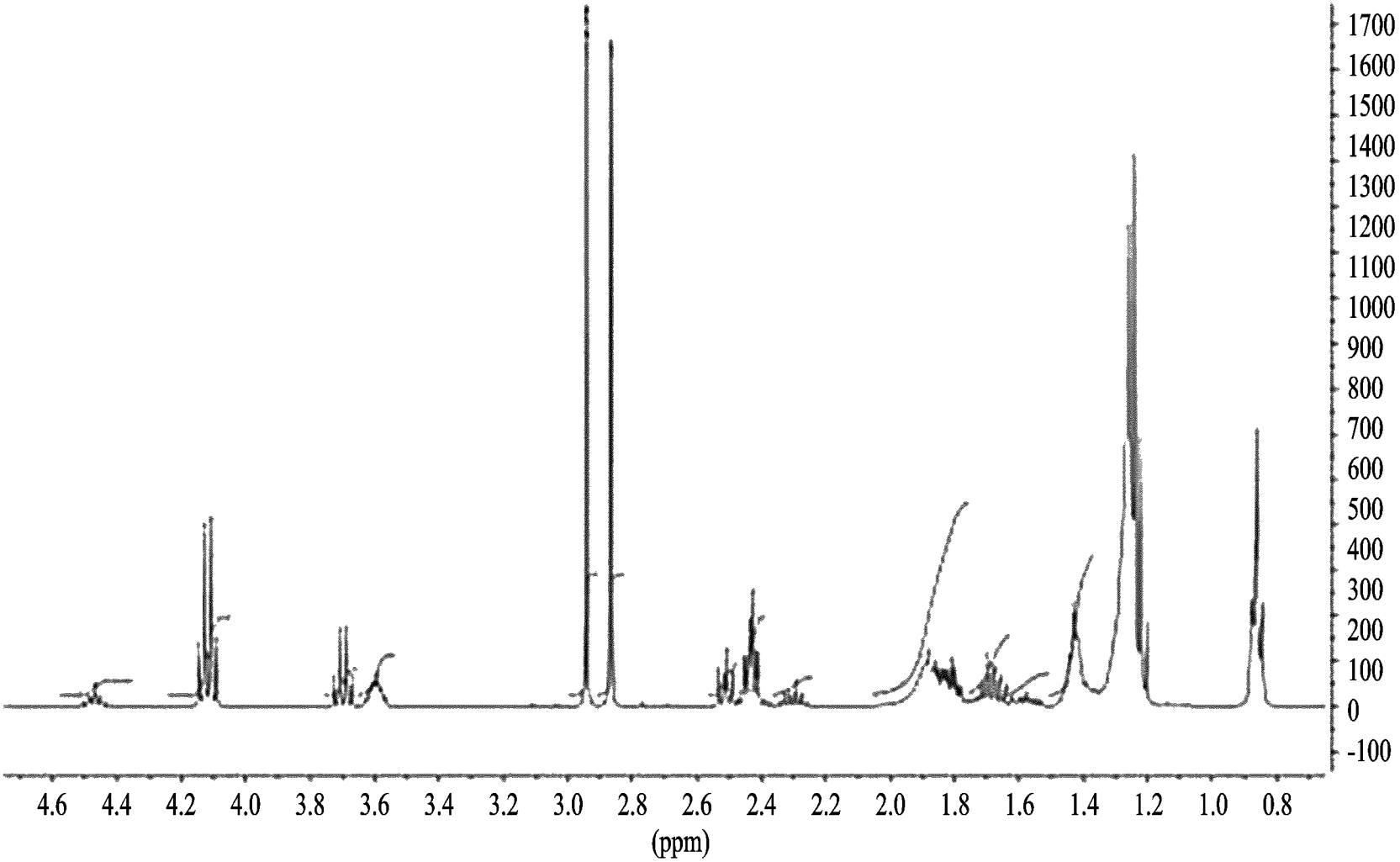
FIG. 10 is a diagram illustrating the results of NMR analysis of ethyl 4-hydroxyundecanoate (2d) prepared in an example according to one embodiment of the present disclosure.
Figure 11:
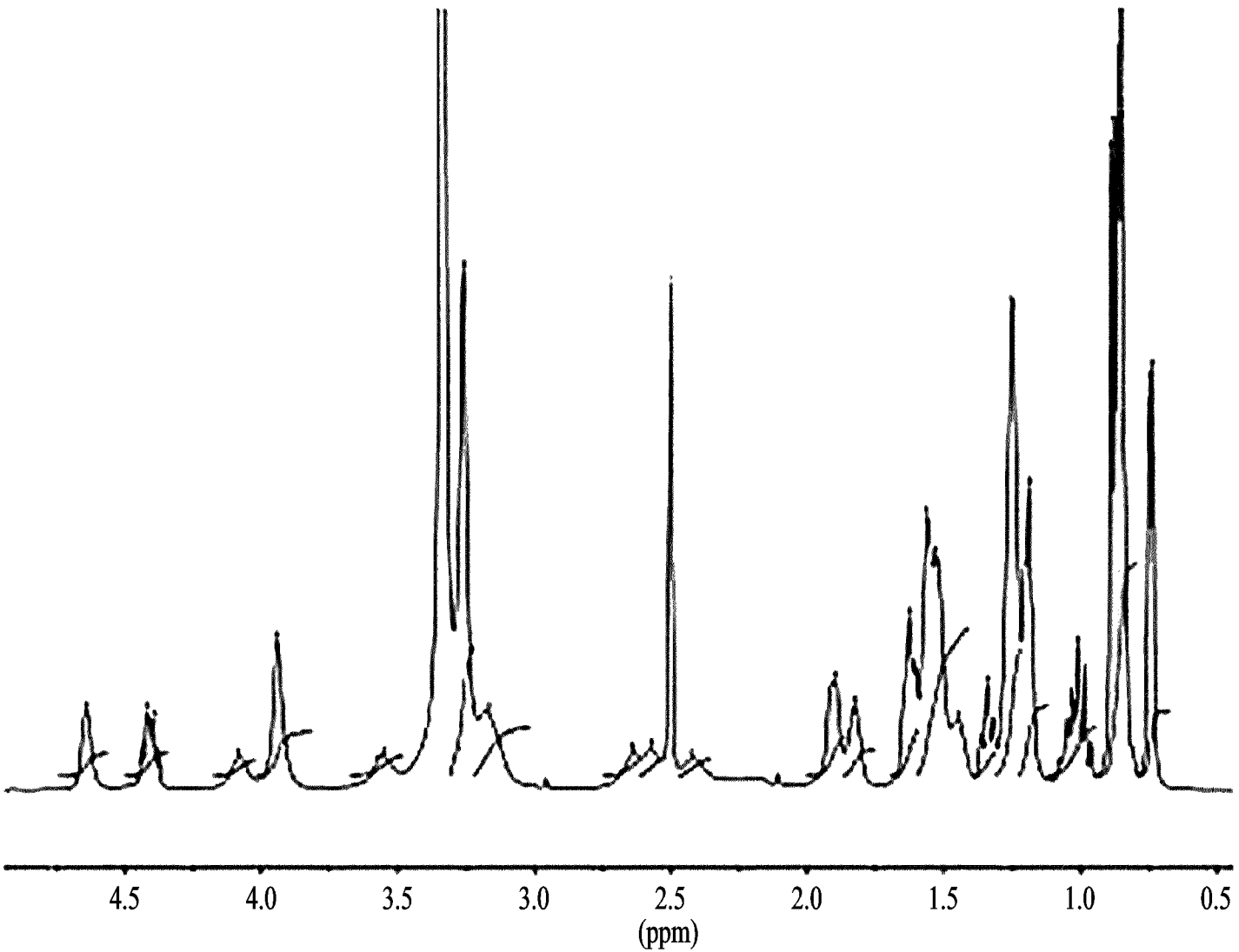
FIG. 11 is a diagram illustrating the results of NMR analysis of ethyl 4-(menthylcarbonyloxy)undecanoate (3d) prepared in an example according to one embodiment of the present disclosure.
Figure 12:
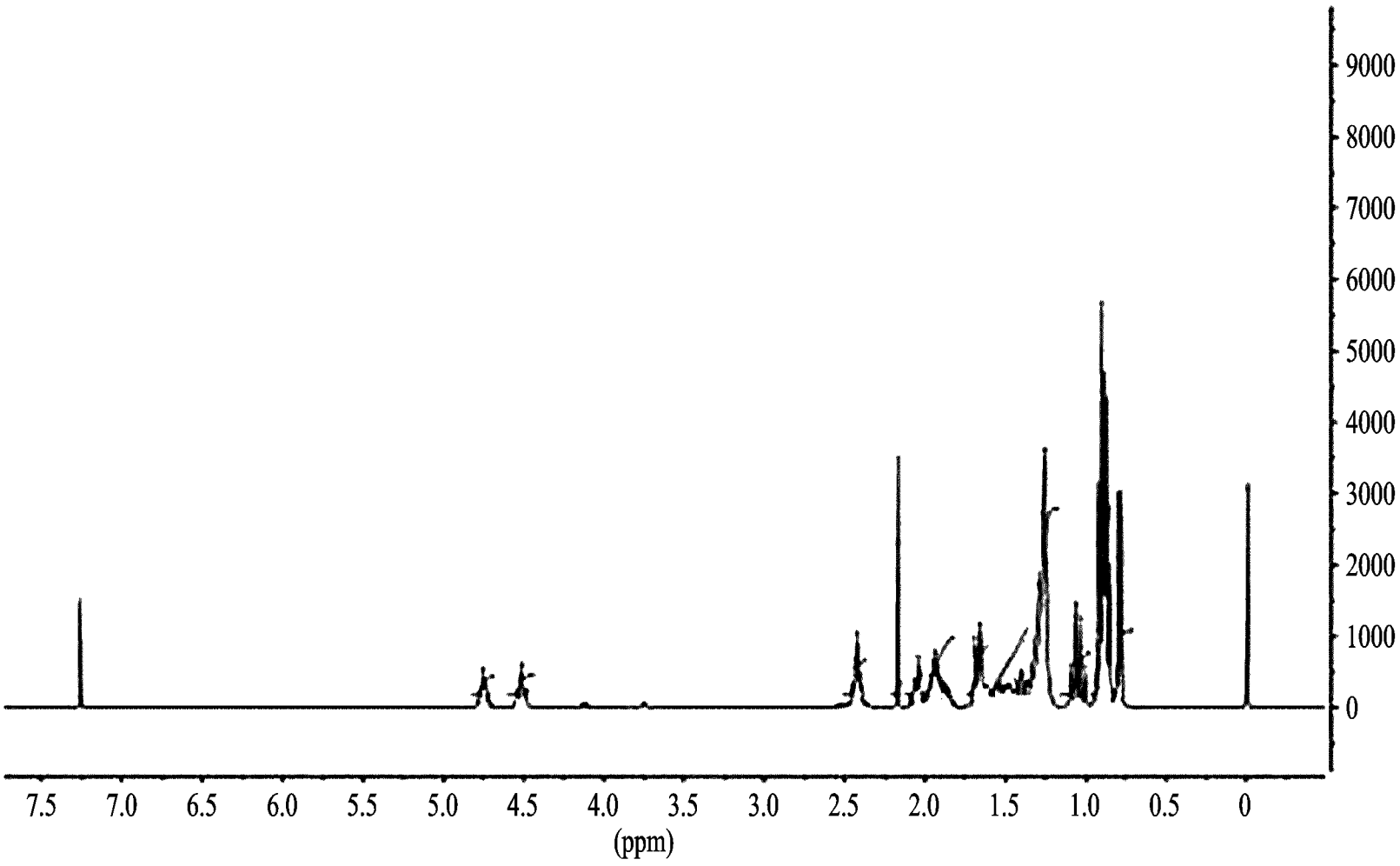
FIG. 12 is a diagram illustrating the results of NMR analysis of 4-(menthylcarbonyloxy)undecanoic acid (4d) prepared in an example according to one embodiment of the present disclosure.
Figure 13:
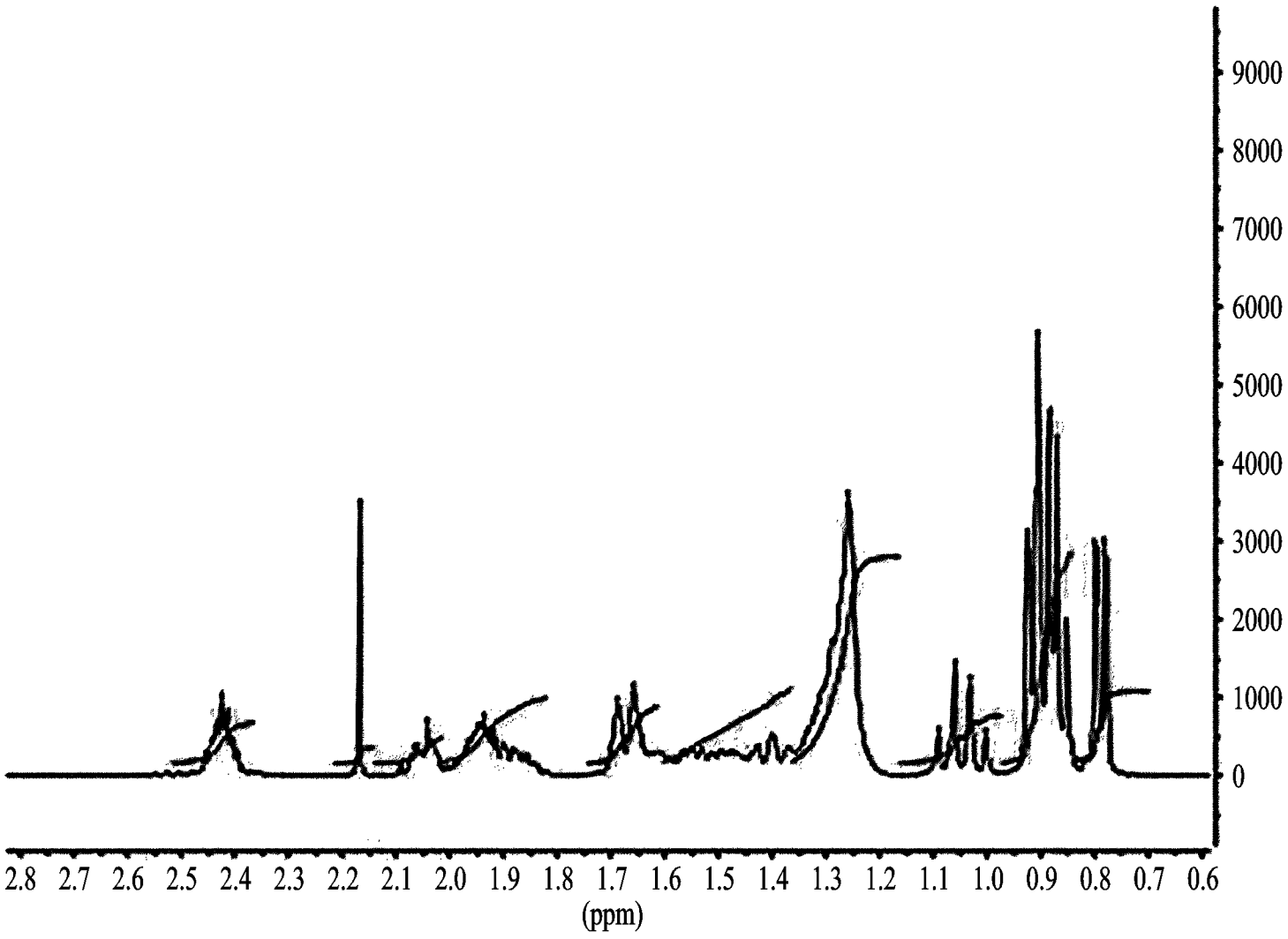
FIG. 13 is a diagram illustrating the results of NMR analysis of 4-(menthylcarbonyloxy)undecanoic acid (4d) prepared in an example according to one embodiment of the present disclosure.
Figure 14:
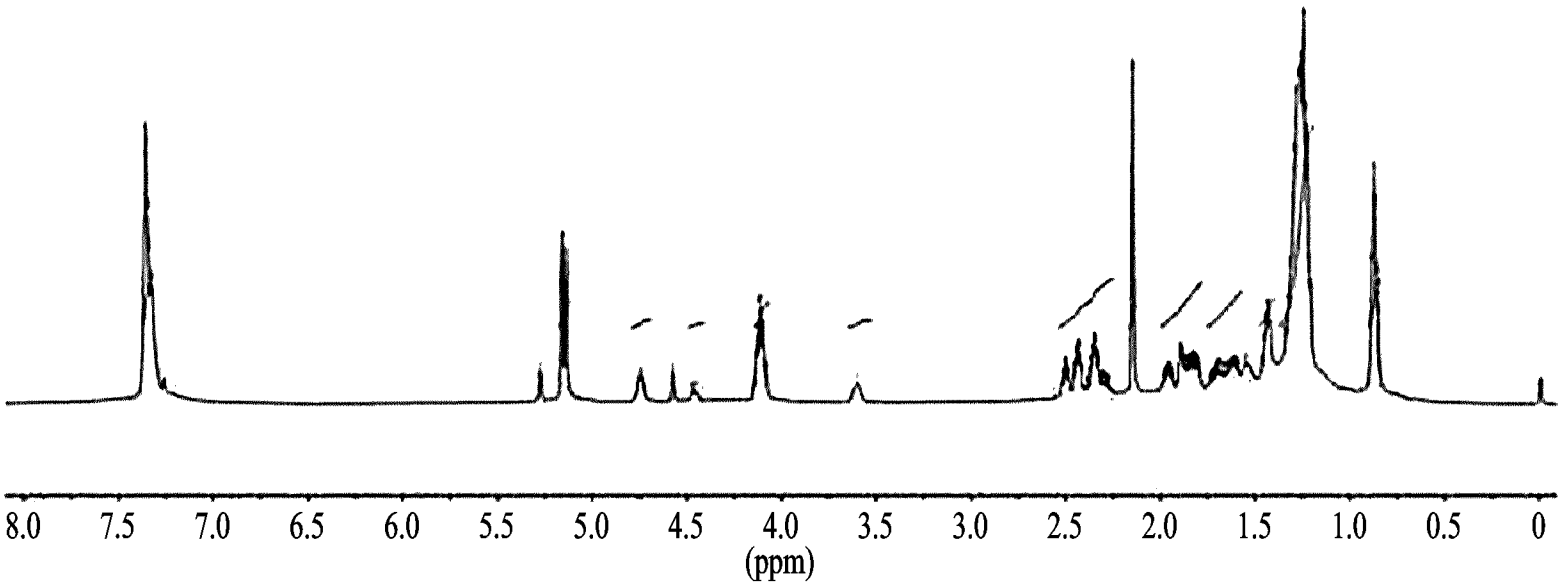
FIG. 14 is a diagram illustrating the results of NMR analysis of ethyl 4-(benzyloxycarbonyloxy)undecanoate (3e) prepared in an example according to one embodiment of the present disclosure.

Hereinafter, embodiments of the present disclosure will be described in detail with reference to the accompanying drawings. In describing the present disclosure, if it is determined that a detailed description of a related well-known function or configuration may unnecessarily obscure the gist of the present disclosure, the detailed description thereof will be omitted. Also, terms used in the present specification, as terms which are used so as to appropriately describe a preferred embodiment of the present disclosure, may be changed depending on the user's or operator's intention or the practices of the field to which the present disclosure pertains. Therefore, the definitions of the terms should be made based on the contents throughout the present specification. The same reference numerals disclosed in each drawing represent the same members.

Throughout the specification, when a member is said to be located "on" other member, this includes not only a case in which a member is in contact with other member but also a case in which another member exists between the two members.

Throughout the specification, when a part "includes" a certain component, it means that other components may be further included, rather than excluding other components.

Hereinafter, the smoking article including a novel flavoring agent according to the present disclosure will be described in detail with reference to embodiments and drawings. However, the present disclosure is not limited to these embodiments and drawings.

The present disclosure relates to a smoking article including a novel flavoring agent, and according to one embodiment of the present disclosure, the flavoring agent may express flavor ingredients by thermal decomposition when heat is applied, thereby enhancing the cigarette taste and improving persistence of the cigarette taste.

The present disclosure relates to a smoking article including a novel flavoring agent that expresses flavor ingredients during thermal decomposition, and according to one embodiment of the present disclosure, the flavoring agent may express volatile flavor ingredients by thermal decomposition when heat is applied. In other words, synthetic compounds that express flavor ingredients upon such thermal decomposition are applied to components of cigarette tobacco (e.g., cigarette paper) so that flavor ingredients (e.g., lactones or menthol) may be expressed by heat during cigarette combustion, particularly during smoldering to provide an effect of relieving the acrid smell of sidestream smoke. In addition, when the smoking article including a novel flavoring agent is applied to the medium of a heating-type tobacco stick, taste persistence of the flavor ingredients may be imparted. For example, in heating-type tobacco, flavor ingredients contained in the medium are exhausted in the initial puff by static heating, but synthetic compounds expressing flavor ingredients during thermal decomposition are expressed only after being decomposed by heat. Therefore, since, even if the puff lasts, the synthetic compounds generate the flavor ingredients even in the last puff, the cigarette taste may be maintained constant.

According to one embodiment of the present disclosure, the flavoring agent may be a compound represented by Formula 1 below.

[Formula 1]

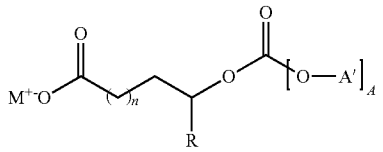

As an example of the present disclosure, the flavoring compound in Formula 1 is covalently bonded with a carbonate linking group

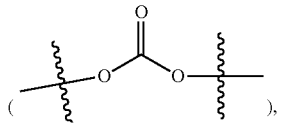

and when heat is applied, the compound of Formula 1 is thermally decomposed and decomposed into a flavoring compound and a lactone compound so that flavor ingredients may be expressed. For example, the compound of Formula 1 reacts with a hydroxyl group of the flavoring compound through a ring opening mechanism of a lactone-based compound to covalently bond the flavoring compound through a carbonate linking group. It may act as a protecting group to prevent conversion to lactone compounds due to ring closure at room temperature (rt) and/or a temperature close thereto. The compound of Formula 1 has structural stability at about room temperature (rt) or a temperature close thereto, has low volatility, and receives heat to break the carbonate linking group with a ring closing mechanism so that the compound of Formula 1 may be decomposed into a lactone-based compound and a flavoring compound to express flavor. Carbon dioxide which is harmless to the human body may be generated during the decomposition process. That is, the carbonate linking group is broken by heat so that the compound of Formula 1 is decomposed into flavoring compounds, and carbon dioxide may be generated. Next, due to ring closure, it may be decomposed into lactone-based compounds to express flavor.

According to one embodiment of the present disclosure, in Formula 1, n may be an integer of 1 or 2. R may be a straight-chain or branched-chain alkyl having 1 to 30 carbon atoms, and preferably a straight-chain or branched-chain alkyl having 2 to 10 carbon atoms.

According to one embodiment of the present disclosure, moiety A in Formula 1 may be a moiety derived from a flavoring compound having at least one of an aromatic ring having a hydroxyl group, an aliphatic ring having a hydroxyl group, and an aliphatic chain having a hydroxyl group. The hydroxyl group may include one or more (e.g., one or two) in a ring, a chain, or both thereof. This may correspond to a hydroxyl group-containing substituent, a basic backbone, and/or a moiety. The hydroxyl group participates in the carbonate linking group in Formula 1, and A' may correspond to a flavoring compound excluding the hydroxyl group. That is, since the hydroxyl group of the flavoring compound in moiety A is protected with a carbonate linking group, a decomposition reaction may be prevented by ring-closure at room temperature.

According to one embodiment of the present disclosure, the flavoring compound may be selected from a cyclic monoterpene-based compound having a hydroxyl group, a monoterpene-based acyclic compound having a hydroxyl group, a $C_6$-$C_{10}$ aromatic compound having a hydroxyl group, a $C_5$-$C_{10}$ or $C_5$-$C_6$ non-aromatic ring having a hydroxyl group, and isomers thereof. For example, the flavoring compound may be selected from the formulas below and may be a compound which is produced when the carbonate linking group of Formula 1 is broken during thermal decomposition.

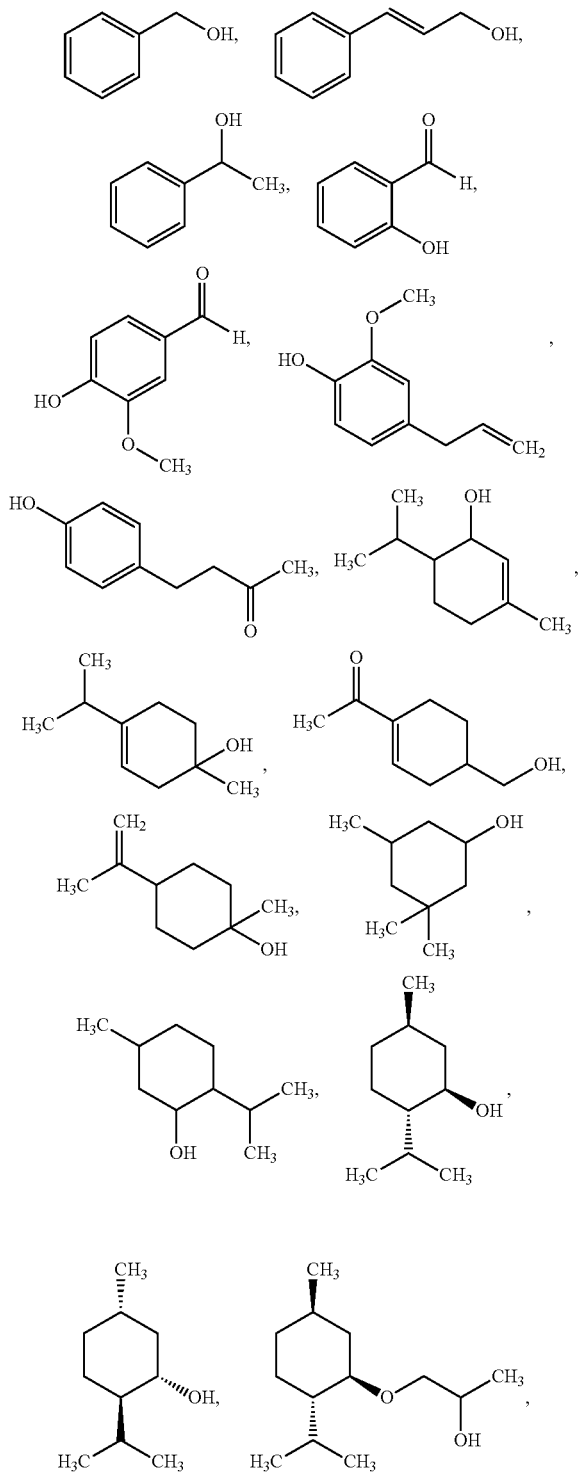

-continued
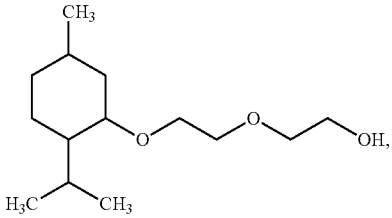
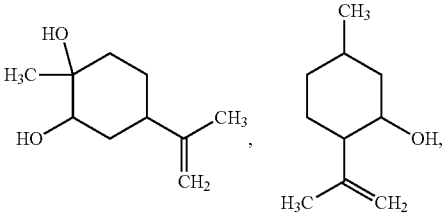
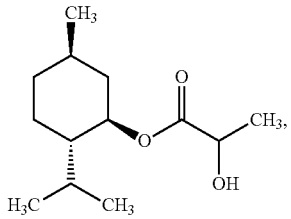
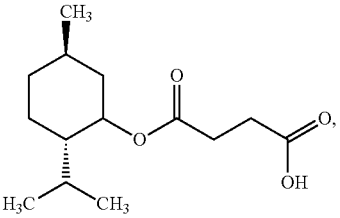
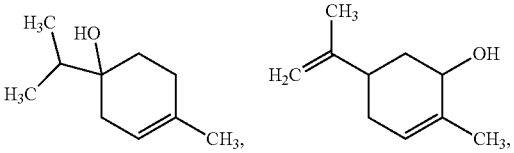
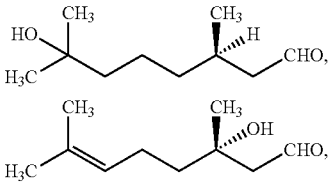
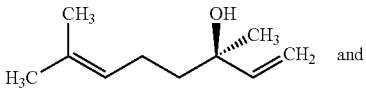
and
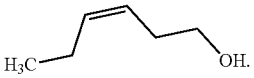
According to one embodiment of the present disclosure, A' in the moiety A may be selected from the formulas below. Here, * corresponds to the oxygen position in the carbonate linking group.
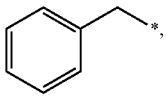
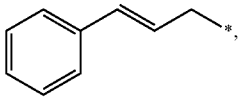
-continued
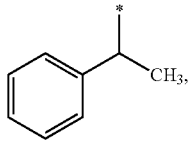
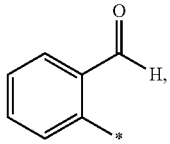
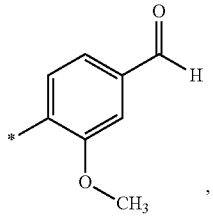
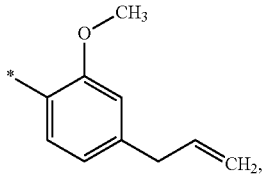
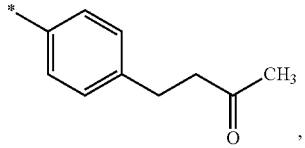
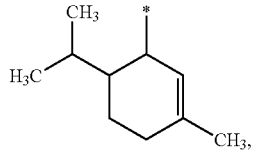
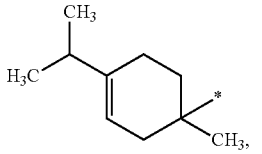
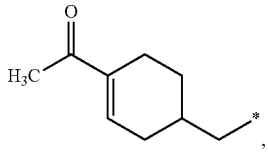
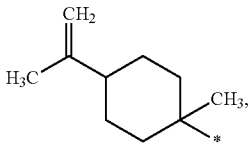
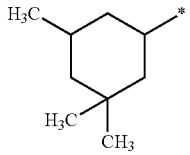
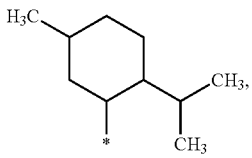
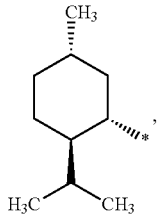
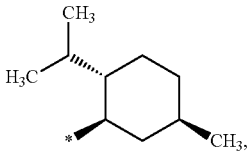
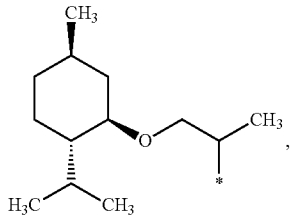
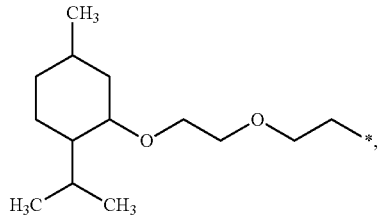
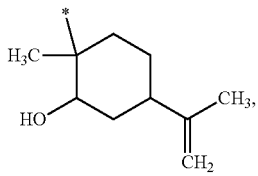
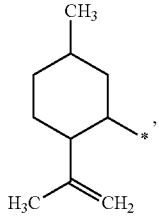

-continued

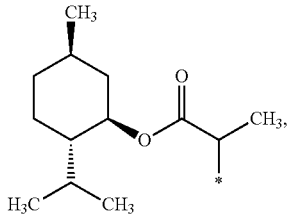

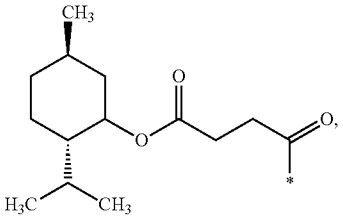

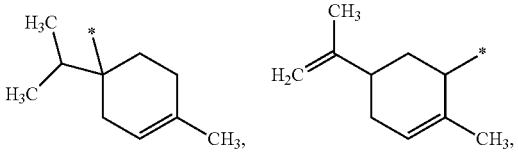

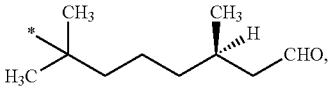

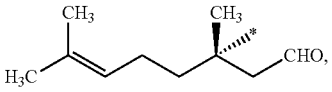

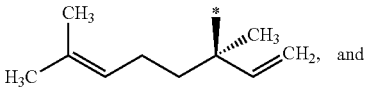

and

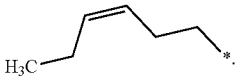

According to one embodiment of the present disclosure, M is selected from an alkali metal and a transition metal, and M may form a salt with oxygen of an ester group to increase solubility in water-soluble solvents, and to facilitate the application of food and smoking articles. For example, the transition metal may be selected from Zr, Mg, Ca, Co, Rh, Ir, Nb, Pd, Pt, Fe, Ru, Os, Cr, Mo, W, Mn, Tc, Re, Cu, Ag, and Au. For example, the alkali metal may be selected from Li, Na, K, Rb, and Cs. For example, M may be a metal that forms a monovalent cation and may be selected from Li, Na, and K.

According to one embodiment of the present disclosure, the lactone compound may be gamma lactone of Formula 2 below or delta lactone of Formula 3 below.

[Formula 2]

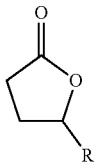

[Formula 3]

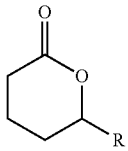

As an example of the present disclosure, R in Formulas 1 and 2 may be a straight-chain or branched-chain alkyl group having 1 to 30 carbon atoms, preferably a straight-chain or branched-chain alkyl group having 2 to 10 carbon atoms.

According to one embodiment of the present disclosure, the lactone compound may be selected from the formulas below.

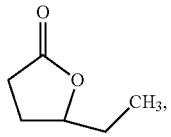

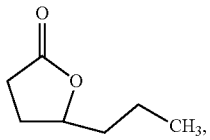

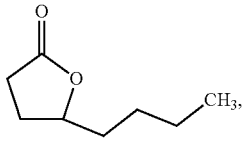

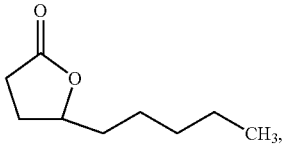

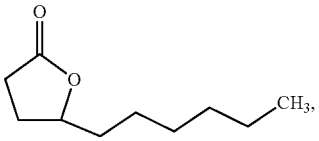

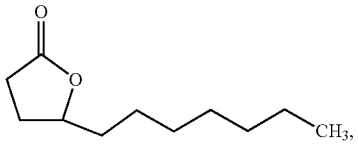

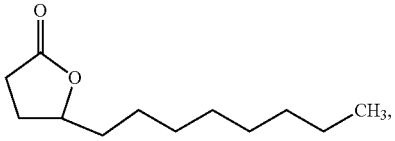

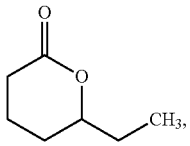

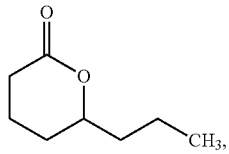

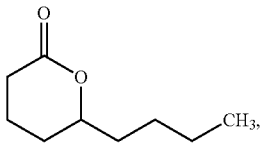

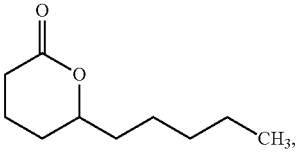

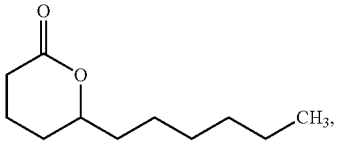

and

-continued
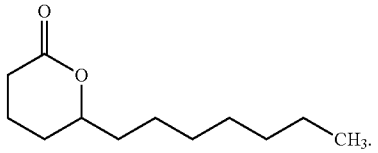
According to one embodiment of the present disclosure, the compound may be selected from Formulas 1-1 to 1-26 below.
[Formula 1-1]
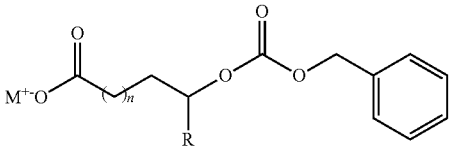
[Formula 1-2]
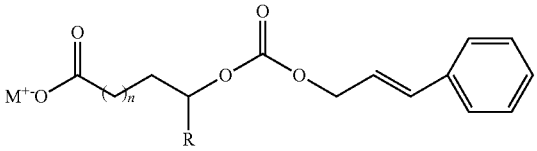
[Formula 1-3]
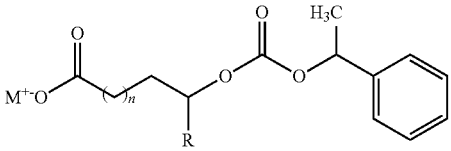
[Formula 1-4]
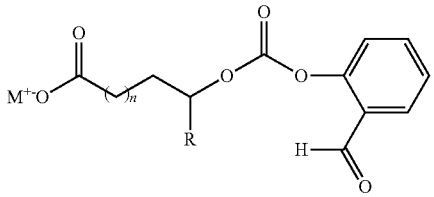
[Formula 1-5]
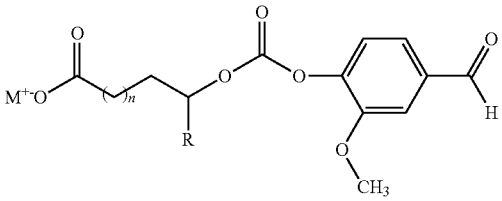
[Formula 1-6]
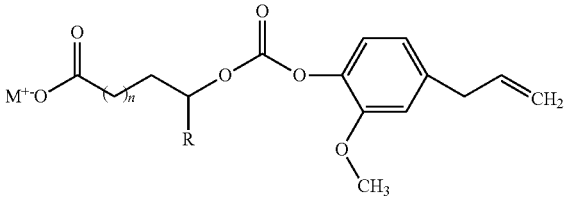
-continued
[Formula 1-7]
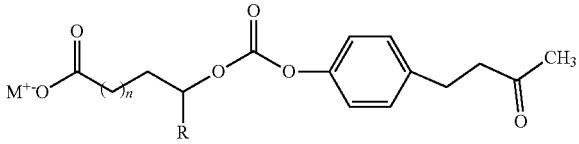
[Formula 1-8]
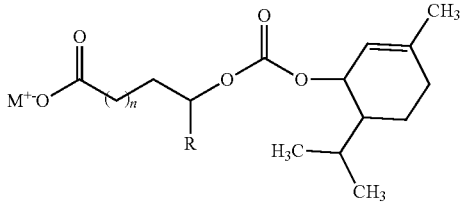
[Formula 1-9]
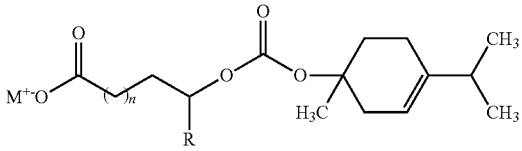
[Formula 1-10]
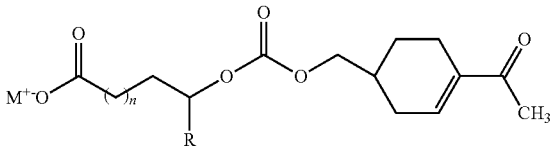
[Formula 1-11]
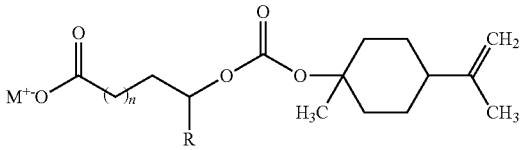
[Formula 1-12]
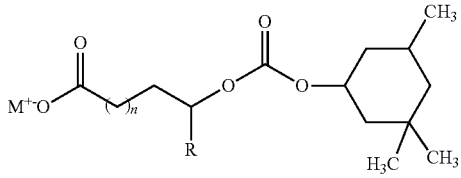
[Formula 1-13]
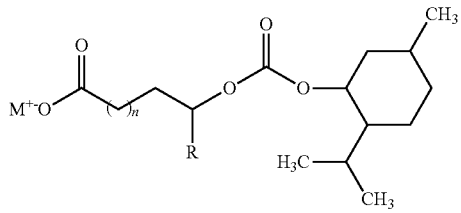
[Formula 1-14]
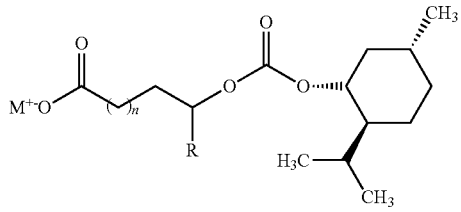

-continued

[Formula 1-15]

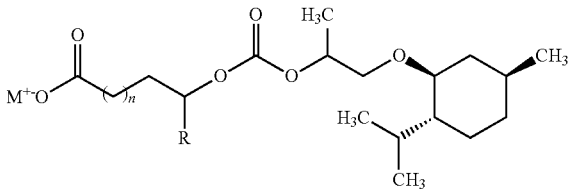

[Formula 1-16]

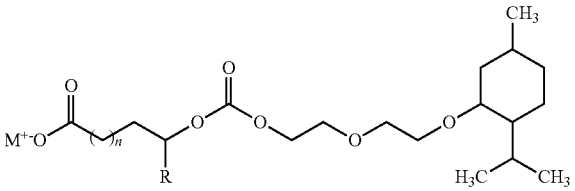

[Formula 1-17]

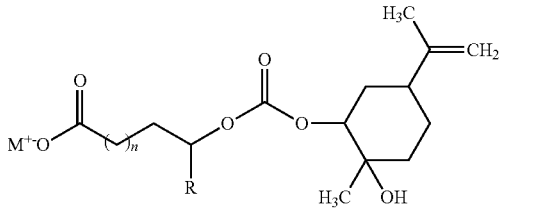

[Formula 1-18]

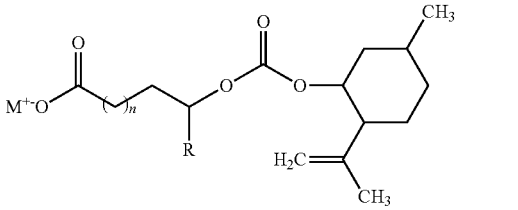

[Formula 1-19]

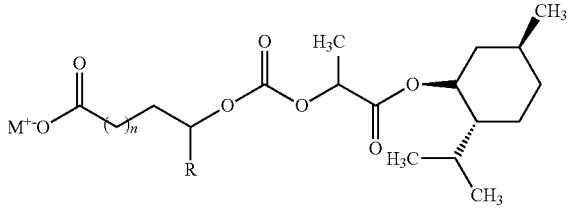

[Formula 1-20]

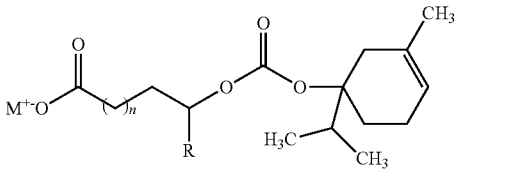

[Formula 1-21]

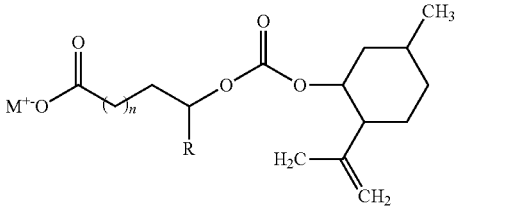

-continued

[Formula 1-22]

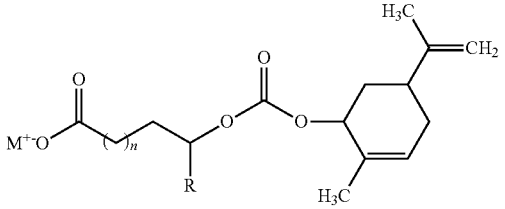

[Formula 1-23]

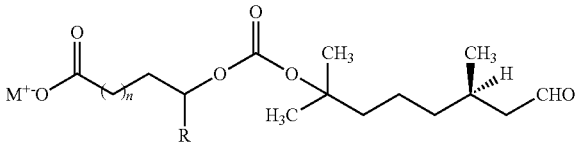

[Formula 1-24]

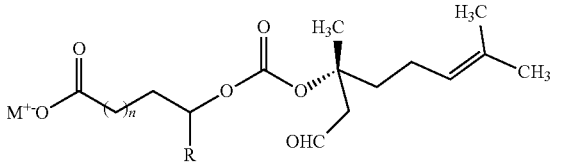

[Formula 1-25]

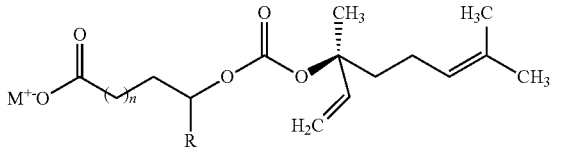

[Formula 1-26]

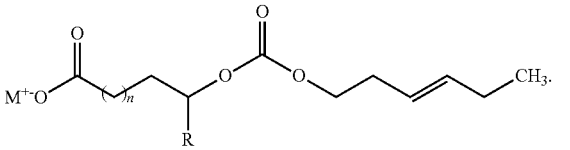

(Here, M and R are as defined in Formula 1 above.)

According to one embodiment of the present disclosure, the compound may be thermally decomposed at a temperature of 70° C. or higher; 80° C. or higher; 90° C. or higher; or 100° C. or higher, preferably 120° C. or higher; 150° C. or higher; or 200° C. or higher, and more preferably 200° C. to 300° C. In addition, the compound may be thermally decomposed in an environment containing oxygen and/or moisture.

According to one embodiment of the present disclosure, the smoking article may include at least one of the above-mentioned flavoring agent compounds represented by Formula 1 according to the present disclosure. Flavor may be provided by thermal decomposition of the flavoring agent upon heating and/or combustion of the smoking article. For example, during heating and/or combustion of the smoking article, flavors may be expressed in the mainstream smoke and/or sidestream smoke, and this may provide an improvement effect in the mainstream smoke and/or sidestream smoke. For example, FIG. 18 shows the migration process of the flavor ingredients according to the present disclosure, and in FIG. 18, the flavoring agent compounds may be applied to at a heated and/or burned site and/or a site close thereto and/or a heat-affected site in the smoking article. When the flavoring agent compounds are applied, an effect of improving sidestream smoke may be provided depending on a process of migrating flavor ingredients into sidestream smoke/mainstream smoke.

Figure 18A:
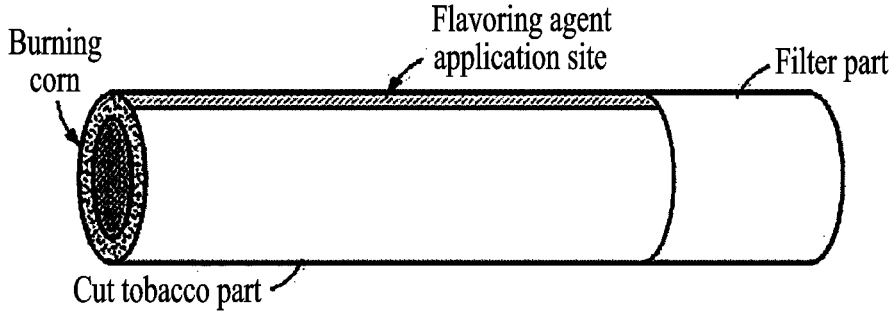
FIG. 18 is a diagram illustrating the process of decomposition and migration of flavor ingredients in the combustion and smoking of the smoking article according to one embodiment of the present disclosure.
Figure 18B:
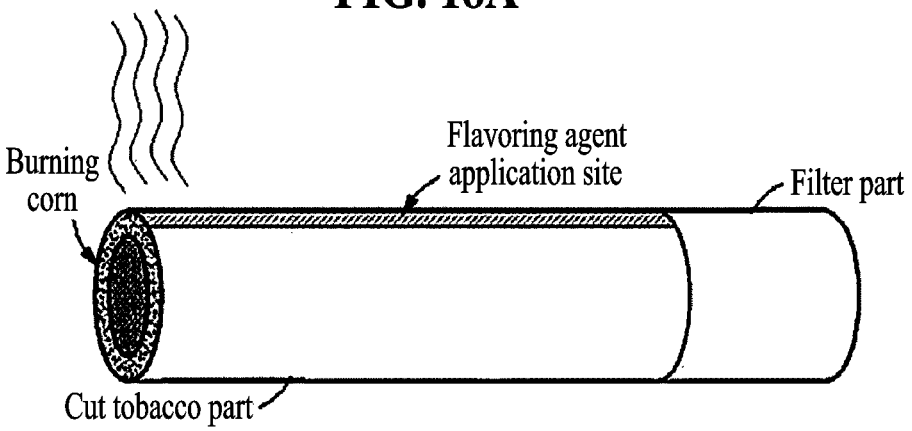

In FIGS. 18A and 18B, burning cones are formed, and then sidestream smoke is produced during smoldering, and flavor ingredients loaded in the sidestream smoke are produced. This is because sidestream smoke-improving synthetic flavors coated on cigarette paper are thermally decomposed by the heat of the burning corns so that flavor ingredients (e.g., gamma-undecalactone) are expressed.

Figure 18C:
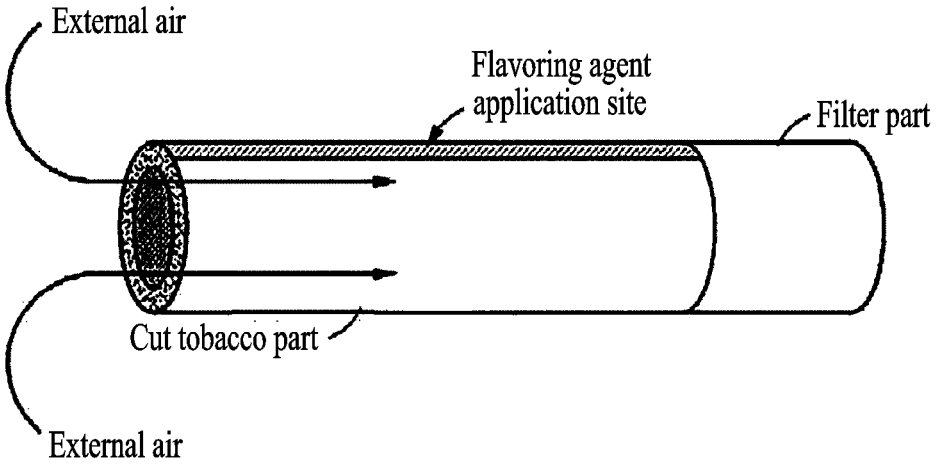

In FIG. 18C, some of the flavor ingredients thermally decomposed while external air is being flown in during smoking may be sucked into the mainstream smoke.

According to one embodiment of the present disclosure, the compound represented by Formula 1 above may be contained in the smoking article in an amount of 0.0001 parts by weight or more; 0.001 parts by weight or more; 0.1 parts by weight or more; 1 part by weight or more; 1 to 5 parts by weight; 1 to 10 parts by weight; or 1 to 20 parts by weight based on 100 parts by weight of the smoking medium. This may provide effects of controlling and improving cigarette taste, atmosphere, and the like caused by sidestream smoke and/or mainstream smoke during smoking.

According to one embodiment of the present disclosure, the compound represented by Formula 1 may express flavor ingredients, e.g., lactone in an amount of 0.00001 part by weight or more; 0.0001 parts by weight or more; 0.001 parts by weight or more; 0.1 parts by weight or more; 1 part by weight or more; 1 to 5 parts by weight; 1 to 10 parts by weight; or 1 to 20 parts by weight based on 100 parts by weight of the smoking medium in the smoking article during smoking. This may provide effects of controlling and improving cigarette taste, atmosphere, and the like caused by sidestream smoke and/or mainstream smoke during smoking.

According to one embodiment of the present disclosure, the smoking article may include a slurry, a paste, a liquid phase, a gel, a powder, beads, a sheet, a film, a fiber, or a molded body containing the compound represented by Formula 1 above.

According to one embodiment of the present disclosure, the smoking article may be applied or manufactured with the compound represented by Formula 1 above or a composition including the same. For example, the smoking article may correspond to a component and/or part. The smoking article may preferably be a component and/or part of a region to be heated. For example, the smoking article may be smoking media (e.g., liquid phases, gels, solid phases, slurries, and pastes), paper tubes, tubes, filters (e.g., tube filters, fiber filters, woven fabric filters, paper filters, and capsule filters), wrapping paper, cigarette paper, tip paper, wrapper, and cartridge (e.g., heating cartridge). The smoking article includes components known in the art of the present disclosure, and unless it departs from the object of the present disclosure, it is not specifically mentioned in this document.

According to one embodiment of the present disclosure, the composition may include the flavoring agent according to the present disclosure (i.e., the flavoring agent compound represented by Formula 1 above), and may further include carriers, additives, or both thereof depending on the use. The carriers and additives are acceptable carriers and additives for food or smoking articles, and may include, for example, solvents, binders, diluents, decomposing agents, lubricants, flavoring agents, colorants, preservatives, antioxidants, emulsifiers, stabilizers, flavor enhancers, and sweeteners, but are not limited thereto.

According to one embodiment of the present disclosure, the composition may further include a base matrix (or matrix) component depending on the use, and the base matrix component may be, for example, paper, pulp, wood, polymer resin (e.g., cellulose), fiber, vegetable oils, petroleum oils (e.g., paraffins), animal oils, waxes, fatty acids (e.g., animal fats with 1 to 50 carbon atoms, vegetable fats, saturated fatty acids, or unsaturated fatty acids (e.g., mono- or polyunsaturated fatty acids)). Organic and/or inorganic or ceramic powders (e.g., chalk, perlite, vermiculite, diatomaceous earth, colloidal silica, magnesium oxide, magnesium sulfate sulfuric, and magnesium carbonate), wetting agents (e.g., glycerin or propylene glycol), and acetate compounds, may be further added to the base matrix component.

According to one embodiment of the present disclosure, the composition may further include tobacco ingredients depending on the use. When the composition is applied to smoking articles, it is possible to express flavors in mainstream smoke and/or sidestream smoke under smoking conditions. The tobacco ingredients may be solid materials based on tobacco raw materials such as sheet-shaped tobacco, cut tobacco, and reconstituted tobacco, and may be selected from leaf tobacco, extruded tobacco, and bandcast tobacco. In addition, the composition may further include an aerosol-generating agent applicable as a cigarette medium, and the aerosol-generating agent may be sorbitol, glycerol, propylene glycol, triethylene glycol, lactic acid, diacetin, triacetin, triethylene glycol diacetate, triethyl citrate, ethyl myristate, isopropyl myristate, methyl stearate, dimethyl dodecanedioate, dimethyl tetradecanedioate, and the like, but is not limited thereto.

According to one embodiment of the present disclosure, the flavoring agent may be contained in the composition in an amount of 0.0001 wt % to 100 wt % (or, exclusive of 100); 0.001 wt % or more; 0.01 wt % or more; 0.1 wt % to 80 wt %; 0.0001 wt % to 60 wt %; 0.001 wt % to 50 wt %; 0.1 wt % to 30 wt %; 1 wt % to 20 wt %; 5 wt % to 20 wt %; or 5 wt % to 10 wt %. Within the above range, the flavor expression function according to the thermal decomposition of the flavoring agent may be obtained, and when the flavoring agent is applied to smoking articles, the effect of improving the cigarette taste may be obtained.

According to one embodiment of the present disclosure, the composition is prepared in various phases, and may be, for example, a solid phase (e.g., powder, crystal, flake, or pulverized material), suspension, slurry, paste, gel, liquid phase, emulsion, or aerosol. For example, the composition may be molded, mixed into a desired product, or applied in a manner known in the art of the present disclosure such as printing, dipping, spraying, and/or coating, but is not specifically mentioned in this document.

According to one embodiment of the present disclosure, the "smoking article" may mean any smokable product or any product that may provide a smoking experience regardless of whether or not it is based on tobacco, tobacco derivatives, expanded tobacco, reconstituted tobacco, or tobacco substitutes. For example, the smoking article may mean a smokeable article capable of generating an aerosol, such as a cigarette, cigar, cigarillo, and electronic cigarette. The smoking article may include an aerosol-generating material or an aerosol-forming substrate. In addition, the smoking articles may include solid materials based on tobacco raw materials, such as sheet-shaped tobacco, cut tobacco, and reconstituted tobacco. The smoking articles may include volatile compounds.

According to one embodiment of the present disclosure, the smoking article may be a cigarette type tobacco, liquid type tobacco, or hybrid type tobacco, and may be a combustion type cigarette or heating type tobacco. Alternatively, the smoking article may be an electronic cigarette (e.g., electronically heated cigarette).

According to one embodiment of the present disclosure, the smoking article may include at least one of sheets, films, and filters on which the compound represented by Formula 1 above is locally printed or coated on the entire surface or at least a portion thereof. In addition, the compound represented by Formula 1 above may be printed or coated on one surface or both surfaces.

According to one embodiment of the present disclosure, the compound represented by Formula 1 above may be printed in a pattern according to the axial direction of the smoking article, transverse direction of the smoking article, or both thereof, and the pattern may be printed locally on the entire surface of at least one surface or at least a portion of the smoking article. For example, single or a plurality of pattern regions may be included along the axial direction, the transverse direction, or both thereof of the rod of the smoking article, and this may control the cigarette taste, atmosphere, etc. by sidestream smoke and/or mainstream smoke during smoking. For example, the pattern may be an arrangement of at least one form of a straight line, a dotted line, a lattice, a polygon, a dot, a circle, and an ellipse. For example, the pattern may have a size of 0.01 mm or more; 0.1 mm or more; 1 mm to 10 mm; or 1 mm to 5 mm. The size may mean thickness, length, diameter, etc., and may mean pitch, interval, etc. in a dot pattern. For example, the pitch may be 0.01 mm to 1 mm.

According to one embodiment of the present disclosure, the smoking article may include a smoking medium part and a filter part. The smoking medium part may include a cigarette paper, a smoking medium, or both thereof, containing the compound represented by Formula 1 above.

According to one embodiment of the present disclosure, the flavoring agent is applied to the cigarette paper of a cigarette so that flavor ingredients (e.g., lactones and/or fragrance ingredients) are expressed by heat during heating and/or combustion of tobacco, particularly during smoke smoldering, and thus the effect of relieving the acrid smell of sidestream smoke may be reduced.

According to one embodiment of the present disclosure, when applied to a medium of a heating-type tobacco stick, taste persistence of the flavor ingredients may be imparted. That is, in the heating-type tobacco, the flavor ingredients contained in the medium are exhausted in the initial puff by static heating, but since the flavor ingredients are expressed only when the flavoring agent is decomposed by heat, the flavor ingredients are produced also in the last puff even if the puff continues, and thus the cigarette taste may be constantly maintained.

According to one embodiment of the present disclosure, when the smoking article is manufactured, the flavoring agent may be applied by mixing the flavoring agent itself with a substrate or base material, or by mixing, printing, dipping (or, impregnating), coating and/or spraying with the substrate or base material using a composition including the flavoring agent.

According to one embodiment of the present disclosure, the compound represented by Formula 1 above may be applied to cigarette paper or added to a smoking medium (e.g., a cigarette medium).

As an example of the present disclosure, a method of adding the compound represented by Formula 1 above to the smoking medium (e.g., a cigarette medium) is a method of adding other flavoring agents to the cigarette medium in a cigarette manufacturing process, and the compound represented by Formula 1 above may be dissolved in a solvent, diluted, and added to a cigarette medium (e.g., cut tobacco) in a spray method. In addition, the compound represented by Formula 1 will be added in various ways when manufacture the sheet-shaped tobacco by dissolving in water in the process of manufacturing sheet-shaped tobacco.

As an example of the present disclosure, the method of applying the compound represented by Formula 1 above to the cigarette paper may be applied variously by a method of applying it to the entire surface of the cigarette paper rod part or locally applying it to at least a portion thereof. The compound represented by Formula 1 above: may be applied to cigarette paper of a cigarette or added to the manufacturing process of cigarette paper (paper) when manufacturing cigarette paper. For example, the cigarette paper may include a pattern region of the compound represented by Formula 1 above locally distributed based on the front surface or the transverse and/or axial direction of the smoking article rod, and control cigarette taste and atmosphere contained in sidestream smoke depending on the location of the pattern region. For example, the pattern region in the cigarette paper may be composed of single or a plurality of pattern regions, may be composed of various parts in the cigarette paper rod, and may be distributed to be close to the distal end of the cigarette paper rod (e.g., a cigarette end or a lightening start part), close to the filter part, in the middle part, and the like. For example, the pattern region in the cigarette paper may be formed in a pattern in the form of a line (or, transverse direction), a strip (or, axial direction), or both thereof in the cigarette rod.

For example, the pattern region in the cigarette paper may be distributed in a region of 5%, 10%, 20%, 30%, 50%, 70%, 90%, and 95% of the length (or rod, i.e., from the distal end) of the cigarette paper.

As an example of the present disclosure, in the method of applying the compound represented by Formula 1 above to the cigarette paper, the method for manufacturing cigarette paper may include, for example, adding the compound represented by Formula 1 above during water immersion or papermaking within the paper manufacturing process, raw material peeling→dark bark removal→selection→water immersion→cooking→washing and selection→bleaching→beating→blending→stirring→papermaking→pressing→drying→completion.

As an example of the present disclosure, the compound represented by Formula 1 above is mixed or dissolved in a solvent, the solvent may include an organic solvent and/or water capable of dispersing and/or dissolving the compound, and if the solvent has solubility, it may be easily applied when performing a process such as a process of making paper using water or alcohol when making paper.

For example, when producing cigarette tobacco at a high speed at a cigarette manufacturing plant, the compound may be added to the cigarette rod part as if ink is stamped.

For example, the compound may be added locally to the cigarette rod part in the manufacture of cigarette tobacco in a spray method.

For example, the compound may be applied in an amount of 0.0001 parts by weight or more; 1 part by weight or more; 5 parts by weight or more; or 1 to 20 parts by weight with respect to 100 parts by weight of the smoking medium (or, cut tobacco).

According to one embodiment of the present disclosure, the smoking medium, e.g., a flavoring agent and tobacco raw materials (e.g., medium raw material, or tobacco leaves) may be contained, or additives may be further contained. In another example, the flavoring agent may be added as a flavoring agent when manufacturing components and/or parts of the smoking article, and may be mixed with a base material, a solvent, a flavoring material, a smoking medium material, and the like that are applicable to the smoking article. Alternatively, the smoking medium may be a liquid phase, gel or solid phase.

Hereinafter, the present disclosure will be described in more detail by examples and comparative examples. However, the following examples are only for illustrating the present disclosure, and the content of the present disclosure is not limited to the following examples.

Example 1

1. Synthesis of Sodium(4-menthylcarbonyloxy)heptanoate (5a)

[Reaction Formula 1]

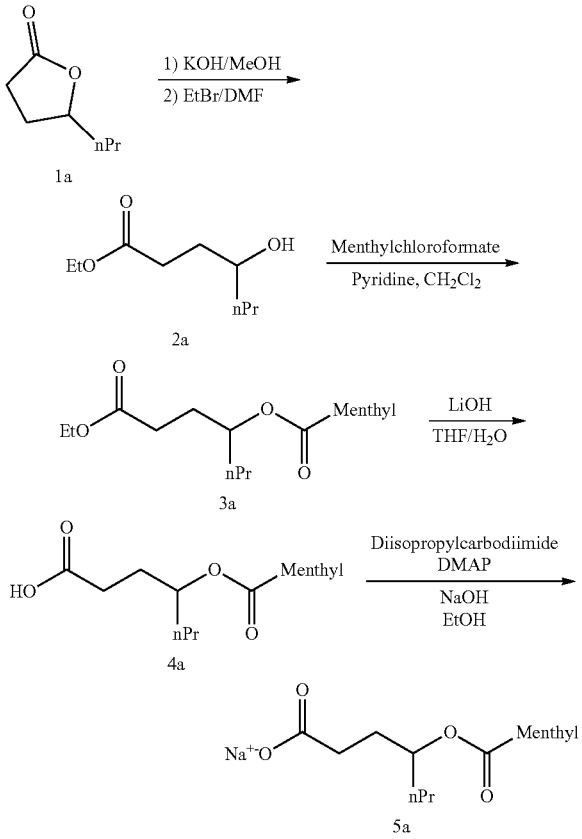

(1-1) Synthesis of ethyl 4-hydroxyheptanoate (2a)

20 g (0.15 mol) of γ-heptalactone was dissolved in 100 mL of methanol, and while stirring the dissolved solution, 11.17 g (0.16 mol, 1.05 eq.) of KOH was slowly put thereinto and reacted at room temperature for 12 hours. After concentrating the reaction solution under reduced pressure, 80 mL of DMF was put thereinto, and while stirring the mixed solution, 17 g (0.15 mol, 1 eq.) of bromoethane was put thereinto, and reacted for 12 hours. 100 mL of water was put into the reaction solution, extracted with ethyl acetate, and then washed with water and brine. The organic layer was dried over $MgSO_4$ and then concentrated under reduced pressure to obtain 18.1 g (66.7%, 2 steps) of the target product 2a.

$^1$H NMR($CDCl_3$, 400.13 MHz); δ 8.01 (s, 1H, —OH), 4.12 (q, 2H, J=8 Hz, COO—$CH_2$—), 3.63 (m, 1H, CH—O), 2.42 (m, 2H, CO—$CH_2$), 1.81 to 0.92 (m, 12H, alkyl)

(1-2) Synthesis of ethyl 4-(menthylcarbonyloxy)heptanoate (3a)

18 g (0.1 mol) of ethyl 4-hydroxyheptanoate (2a) was dissolved in 120 mL of THE, 16 g (0.2 mol, 2 eq.) of pyridine was put into the dissolved solution and cooled with ice water, and while stirring the cooled mixed solution, 23 g (0.1 mol, 1 eq.) of menthyl chloroformate and 20 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure to obtain 30 g (yield of 81%) of the target product 3a as a yellow liquid.

$^1$H NMR($CDCl_3$, 400.13 MHz); δ 4.74(7tet, 1H, J=4 Hz, —COOCH—), 4.51(td, 1H, J=9, 4 Hz, COO—CH—), 4.12 (q, 2H, J=8 Hz, COO—$CH_2$—), 2.36(m, 2H, CO—$CH_2$—), 1.93 to 0.79(m, 30H, alkyl)

(1-3) Synthesis of 4-(menthylcarbonyloxy)heptanoic acid (4a)

25 g (68.5 mmol) of ethyl 4-(menthylcarbonyloxy) heptanoate (3a) was dissolved in 100 mL of THF and 30 mL of distilled water, and 4.2 g (102.4 mmol, 1.5 eq.) of lithium hydroxide monohydrate was put into the dissolved solution and reacted at room temperature for 12 hours. 50 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure to obtain 21.8 g (yield of 81%) of the target product 4a as a yellow liquid.

$^1$H NMR($CDCl_3$, 400.13 MHz); δ 4.76(m, 1H, —COOCH—), 4.52(td, 1H, J=9, 4 Hz, COO—CH—), 4.11 (q, 2H, J=8 Hz, COO—$CH_2$—), 2.42(m, 2H, CO—$CH_2$—), 1.99 to 0.82 (m, 27H, alkyl)

(1-4) Synthesis of Sodium(4-menthylcarbonyloxy)heptanoate (5a)

2.5 g (7.5 mmol) of 4-(menthylcarbonyloxy) heptanoic acid (4a) was dissolved in 20 mL of 95% ethanol, and 0.29 g (0.95 eq.) of 98% NaOH was put into the dissolved solution, and stirred at room temperature for 2 hours. Water and ethanol were blown away using an azeotropic phenomenon, toluene was added to remove water, and then hexane and ethyl acetate were put thereinto and filtered to obtain a white solid.

2. Synthesis of Sodium 4-(menthylcarbonyloxy)nonanoate (5b)

[Reaction Formula 2]

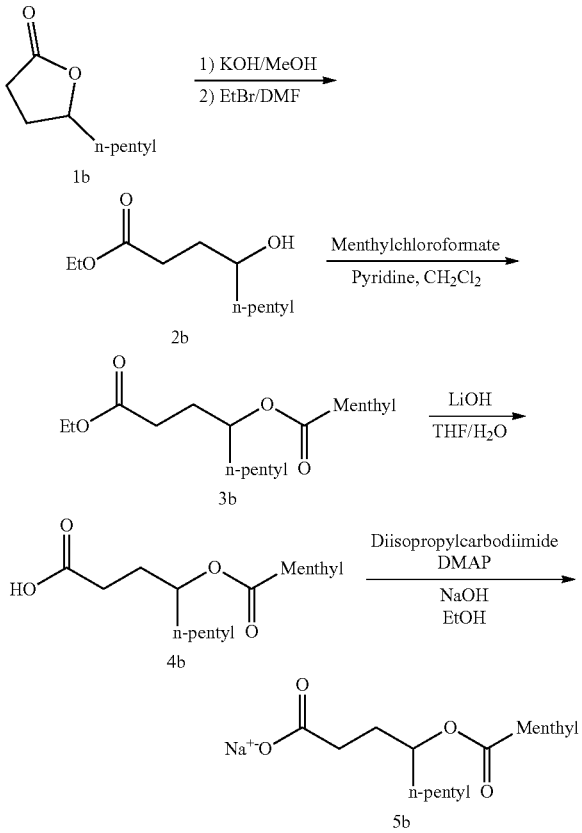

(2-1) Synthesis of ethyl 4-hydroxynonanoate (2b)

20 g (0.13 mol) of γ-nonalactone was dissolved in 100 mL of methanol, and while stirring the dissolved solution, 9.18 g (0.14 mol, 1.05 eq.) of KOH was slowly put thereinto and reacted at room temperature for 12 hours. After concentrating the reaction solution under reduced pressure, 80 mL of DMF was put thereinto, and while stirring the mixed solution, 14 g (0.13 mol, 1 eq.) of bromoethane was put thereinto, and reacted for 12 hours. 100 mL of water was put into the reaction solution, extracted with ethyl acetate, and then washed with water and brine. The organic layer was dried over $MgSO_4$ and then concentrated under reduced pressure to obtain 24 g (93%, 2 steps) of the target product 2b.

(2-2) Synthesis of ethyl 4-(menthylcarbonyloxy)nonanoate (3b)

24 g (0.12 mol) of ethyl 4-hydroxynonanoate (2b) was dissolved in 120 mL of THE, 18 g (0.42 mol, 2 eq.) of pyridine was put into the dissolved solution and cooled with ice water, and while stirring the cooled mixed solution, 26 g (0.12 mol, 1 eq.) of menthyl chloroformate and 30 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure to obtain 34 g (yield of 74.5%) of the target product 3b as a yellow liquid.

$^1$H NMR($CDCl_3$, 400.13 MHz); δ 4.74(7tet, 1H, J=4 Hz, —COOCH—), 4.51(td, 1H, J=9, 4 Hz, COO—CH—), 4.12 (q, 2H, J=8 Hz, COO—$CH_2$—), 2.36(m, 2H, CO—$CH_2$—), 1.93 to 0.79(m, 23H, alkyl)

(2-3) Synthesis of 4-(menthylcarbonyloxy)nonanoic acid (4b)

11.5 g (29.9 mmol) of ethyl 4-(menthylcarbonyloxy) nonanoate (3b) was dissolved in 50 mL of THF and 20 mL of distilled water, and 2 g (48.7 mmol, 1.6 eq.) of lithium hydroxide monohydrate was put into the dissolved solution and reacted at room temperature for 12 hours. 50 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure to obtain 8.6 g (yield of 80%) of the target product 4b as a yellow liquid.

$^1$H NMR($CDCl_3$, 400.13 MHz); δ 4.75(m, 1H, —COOCH—), 4.49 (m, 1H, COO—CH—), 2.04 (m, 2H, CO—$CH_2$—), 1.93 to 0.79 (m, 31H, alkyl)

(2-4) Synthesis of Sodium 4-(menthylcarbonyloxy)nonanoate (5b)

2.5 g (7.5 mmol) of 4-(menthylcarbonyloxy) nonanoic acid (4b) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then hexane and ethyl acetate were put thereinto and filtered to obtain a white solid.

3. Sodium 5-(menthylcarbonyloxy)decanoate (5c)

[Reaction Formula 3]

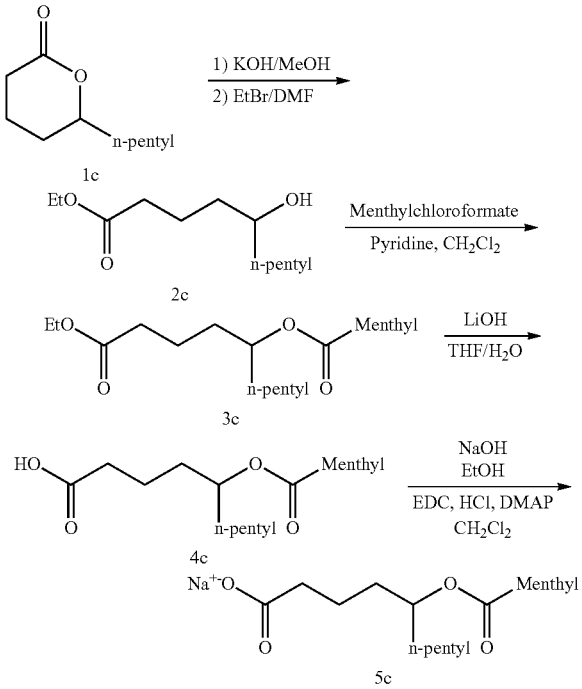

(3-1) Synthesis of Ethyl 5-hydroxydecanoate (2c)

10 g (58.7 mmol) of 8-decalactone was dissolved in 50 mL of methanol, and while stirring the dissolved solution, 4.2 g (64.7 mmol, 1.05 eq.) of KOH was slowly put thereinto and reacted at room temperature for 12 hours. After concentrating the reaction solution under reduced pressure, 40 mL of DMF was put thereinto, and while stirring the mixed solution, 6.4 g (58.7 mmol, 1 eq) of bromoethane was put thereinto, and reacted for 12 hours.

100 ml of water was put into the reaction solution, extracted with ethyl acetate, and then washed with water and brine. The organic layer was dried over $MgSO_4$ and then concentrated under reduced pressure to obtain 7.6 g (60%, 2 steps) of the target product 2c.

(3-2) Synthesis of ethyl 5-(menthylcarbonyloxy)decanoate (3c)

7.5 g (34.6 mmol) of ethyl 5-hydroxydecanoate (2c) was dissolved in 50 mL of THF, 5.3 g (69.2 mmol, 2 eq.) of pyridine was put into the dissolved solution and cooled with ice water, and while stirring the cooled mixed solution, 8.3 g (37.9 mmol, 1.1 eq.) of menthyl chloroformate and 20 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure. The mixture was subjected to silica gel column chromatography using a mixed solvent of n-hexane and ethyl acetate (7:1) to obtain 4.5 g (yield of 32.6%) of the target product 3c.

$^1$H NMR($CDCl_3$, 400.13 MHz); § 4.72(m, 1H, —COOCH—), 4.52(m, 1H, COO—CH—), 4.12(q, 2H, J=8 Hz, COO—$CH_2$—), 2.31(t, 2H, J=8 Hz, CO—$CH_2$—), 2.08 to 0.86(m, 27H, alkyl), 0.79(d, 6H, J=8 Hz, —$CH_3$).

(3-3) Synthesis of 5-(menthylcarbonyloxy)decanoic Acid (4c)

2.7 g (6.8 mmol) of ethyl 4-(menthylcarbonyloxy) nonanoate (3c) was dissolved in 20 mL of THF and 10 mL of distilled water, and 0.42 g (10.2 mmol, 1.5 eq.) of lithium hydroxide monohydrate was put into the dissolved solution and reacted at room temperature for 12 hours. 10 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure to obtain 2.1 g (yield of 78%) of the target product 4c as a yellow liquid.

$^1$H NMR($CDCl_3$, 400.13 MHz); δ 4.72(m, 1H, —COOCH—), 4.51 (td, 1H, J=8, 4 Hz, COO—CH—), 4.11(q, 2H, J=8 Hz, COO—$CH_2$—), 2.38 (m, 2H, CO—$CH_2$—), 2.06 to 0.78(m, 33H, alkyl)

(3-4) Synthesis of Sodium 5-(menthylcarbonyloxy)decanoate (5c)

7.5 mmol of 5-(menthylcarbonyloxy) decanoic acid (4c) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then hexane and ethyl acetate were put thereinto and filtered to obtain a white solid.

4. Synthesis of Sodium (4-menthylcarbonyloxy)undecanoate (5d)

[Reaction Formula 4]

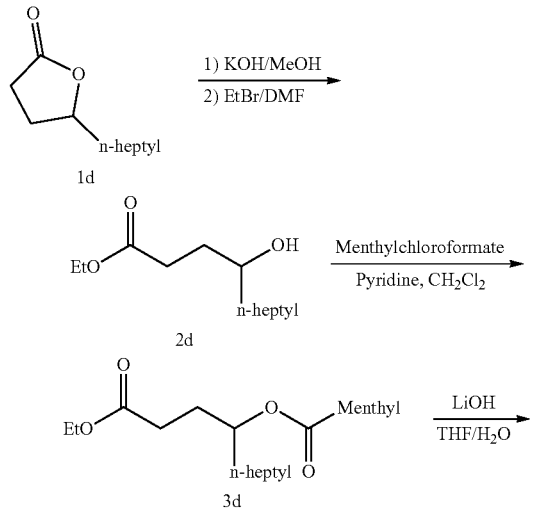

-continued

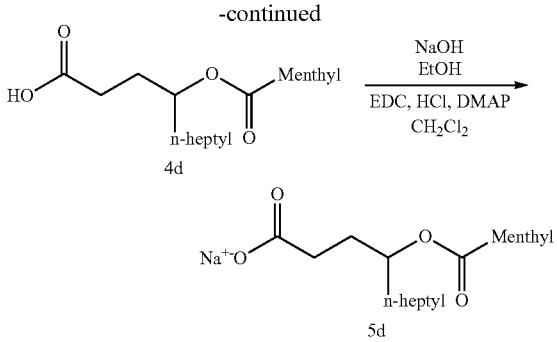

(4-1) Synthesis of ethyl 4-hydroxyundecanoate (2d)

10 g (54.2 mmol) of γ-undecalactone was dissolved in 50 mL of methanol, and while stirring the dissolved solution, 3.9 g (56.9 mmol, 1.05 eq.) of KOH was slowly put thereinto and reacted at room temperature for 12 hours. After concentrating the reaction solution under reduced pressure, 50 mL of DMF was put thereinto, and while stirring the mixed solution, 5.9 g (54.2 mmol, 1 eq.) of bromoethane was put thereinto, and reacted for 12 hours. 80 mL of water was put into the reaction solution, extracted with ethyl acetate, and then washed with water and brine. The organic layer was dried over $MgSO_4$ and then concentrated under reduced pressure to obtain 10.7 g (85.6%, 2 steps) of the target product 2d.

$^1$H NMR($CDCl_3$, 400.13 MHz); δ 4.12(q, 2H, J=8 Hz, COO—$CH_2$—), 3.59(m, 1H, CH—O), 2.43(m, 2H, CO—$CH_2$), 1.81 to 0.92(m, 20H, alkyl)

(4-2) Synthesis of ethyl 4-(menthylcarbonyloxy)undecanoate (3d)

11 g (47.7 mmol) of ethyl 4-hydroxyundecanoate (2d) was dissolved in 60 mL of THF, 6.8 g (95.5 mmol, 2 eq.) of pyridine was put into the dissolved solution and cooled with ice water, and while stirring the cooled mixed solution, 10.5 g (47.7 mmol, 1 eq.) of menthyl chloroformate and 20 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure to obtain 8.3 g (yield of 42.1%) of the target product 3d as a yellow liquid.

$^1$H NMR($CDCl_3$, 400.13 MHz); δ 4.74(7tet, 1H, J=4 Hz, —COOCH—), 4.51 (td, 1H, J=9, 4 Hz, COO—CH—), 4.12(q, 2H, J=8 Hz, COO—$CH_2$—), 2.36(m, 2H, CO—$CH_2$—), 1.93 to 0.79 (m, 23H, alkyl)

(4-3) Synthesis of 4-(menthylcarbonyloxy)undecanoic Acid (4d)

8.3 g (19.4 mmol) of ethyl 4-(menthylcarbonyloxy)undecanoate (3d) was dissolved in 30 mL of THF and 20 mL of distilled water, and 1.2 g (29.1 mmol, 1.5 eq.) of lithium hydroxide monohydrate was put into the dissolved solution and reacted at room temperature for 12 hours. 20 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure. The mixture was subjected to silica gel column chromatography using a mixed solvent of hexane (n-hexane) and ethyl acetate (8:1) to obtain 6.8 g (yield of 91.8%) of the target product 4d.

$^1$H NMR($CDCl_3$, 400.13 MHz); δ 4.75(m, 1H, —COOCH—), 4.51(m, 1H, COO—CH—), 2.43(m, 2H, CO—$CH_2$—), 2.17 to 0.78(m, 35H, alkyl)

(4-4) Synthesis of Sodium (4-menthylcarbonyloxy)undecanoate (5d)

2.5 g (7.5 mmol) of 4-(menthylcarbonyloxy)undecanoic acid (4d) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then hexane (n-hexane) and ethyl acetate were put thereinto and filtered to obtain a white solid.

5. Synthesis of Sodium 4-(benzyloxycarbonyloxy)undecanoate (5e)

[Reaction Formula 5]

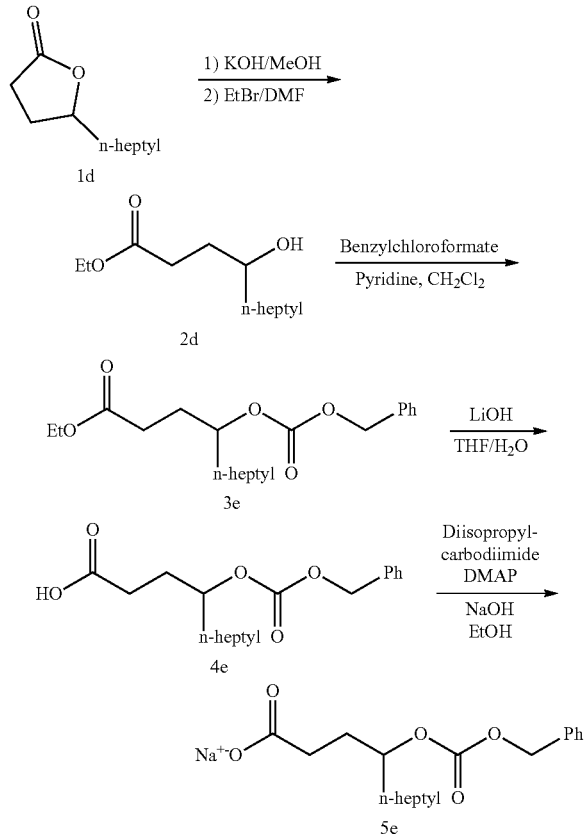

(5-1) Synthesis of Ethyl 4-hydroxyundecanoate (2d)

10 g (54.2 mmol) of γ-undecalactone was dissolved in 50 mL of methanol, and while stirring the dissolved solution, 3.9 g (56.9 mmol, 1.05 eq.) of KOH was slowly put thereinto and reacted at room temperature for 12 hours. After concentrating the reaction solution under reduced pressure, 50 mL of DMF was put thereinto, and while stirring the mixed solution, 5.9 g (54.2 mmol, 1 eq.) of bromoethane was put thereinto, and reacted for 12 hours.

80 mL of water was put into the reaction solution, extracted with ethyl acetate, and then washed with water and brine. The organic layer was dried over $MgSO_4$ and then concentrated under reduced pressure to obtain 10.7 g (85.6%, 2 steps) of the target product 2d.

$^1$H NMR($CDCl_3$, 400.13 MHz); δ 4.12(q, 2H, J=8 Hz, COO—$CH_2$—), 3.59 (m, 1H, CH—O), 2.43 (m, 2H, CO—$CH_2$), 1.81 to 0.92(m, 20H, alkyl)

(5-2) Synthesis of Ethyl 4-(benzyloxycarbonyloxy)undecanoate (3e)

8.3 g (36 mmol) of ethyl 4-hydroxyundecanoate (2d) was dissolved in 50 mL of THF, 5.5 g (72.3 mmol, 2 eq.) of pyridine was put into the dissolved solution and cooled with ice water, and while stirring the cooled mixed solution, 6.1 g (35.3 mmol, 1 eq.) of benzyl chloroformate and 20 mL of THF were slowly dropped thereinto. After 1 hour, the reaction solution was raised to room temperature and reacted overnight, and then water was put thereinto and extracted with ethyl acetate. The organic layer was washed with dilute hydrochloric acid, a saturated sodium bicarbonate solution, and brine, respectively, dried over $MgSO_4$, and concentrated under reduced pressure to obtain 9.9 g (yield of 75.6%) of the target product 3e as a yellow liquid. $^1$H NMR($CDCl_3$, 400.13 MHz); δ 7.37 to 7.34(m, 5H, ph), 5.14(m, 2H, O—$CH_2$-Ph), 4.12(brs, 1H, O—CH—), 2.42(m, 2H, CO—$CH_2$—), 1.90 to 0.79(m, 21H, alkyl)

(5-3) Synthesis of 4-(benzyloxycarbonyloxy)undecanoic Acid (4e)

10 g (27.5 mmol) of ethyl 4-(benzyloxycarbonyloxy) undecanoate (3e) was dissolved in 30 mL of THF and 20 mL of distilled water, and 1.7 g (41.4 mmol, 1.5 eq.) of lithium hydroxide monohydrate was put into the dissolved solution and reacted at room temperature for 12 hours. 20 mL of distilled water was added to the reaction solution and extracted with ether. The aqueous layer was adjusted to pH 3 by putting concentrated hydrochloric acid thereinto and then extracted with ethyl acetate. After the organic layer was washed with brine, the washed organic layer was dried over $MgSO_4$ and concentrated under reduced pressure to obtain 8.2 g (yield of 89%) of the target product 4e.

$^1$H NMR($CDCl_3$, 400.13 MHz); δ 7.37 to 7.35(m, 5H, ph), 5.14(m, 2H, O—$CH_2$—Ph), 4.48(m, 1H, O—CH—), 2.47 (m, 2H, CO—$CH_2$—), 1.90 to 0.79 (m, 21H, alkyl)

(5-4) Synthesis of Sodium 4-(Benzyloxycarbonyloxy)Undecanoate (5e)

2.5 g (7.5 mmol) of 4-(benzyloxycarbonyloxy)undecanoic acid (4e) was dissolved in 20 mL of 95% ethanol, and 0.29 g (0.95 eq.) of 98% NaOH was put into the dissolved solution, and stirred at room temperature for 2 hours. Water and ethanol were blown away using the azeotropic phenomenon, toluene was added to remove water, and then hexane (n-hexane) and ethyl acetate were put thereinto and filtered to obtain a white solid.

Experimental Example

A pyrolysis test was conducted to confirm the pyrolytic behavior of the 5d Compound (2B) when exposed to heat, which was observed by a commonly-known pyrolysis-gas chromatography/mass spectrometry [Py-GC/MS]. The pyrolyzer was performed in a system in which the 『Double-Shot Pyrolyzer 2020iD』 (Frontier Lab, Japan) was connected to the GC/MS (Agilent 6890 GC, USA/Aginelt 7890 MSD, USA) equipment. After diluting 2B to 2.5% concentration in an ethyl alcohol solution, 10 ul was loaded into a pyrolyzer sample cup, and then thermally decomposed. The temperature experienced by the sample was controlled by specifying the temperature of the furnace of the Double-Shot Pyrolyzer for the thermal decomposition temperature. The initial thermal decomposition temperature was set at 80° C. for 30 seconds so that the Target Compound (2B) in the sample cup was allowed to undergo thermal decomposition by exposing the sample cup having a sample placed therein to the furnace. The components produced by heat or volatilized by heat were directly injected into the injector of GC/MS and separated. The sample cup was removed from the furnace during GC/MS analysis after thermal decomposition so that it was not affected by the thermal decomposition temperature, and after the GC/MS analysis by the first thermal decomposition was completed, the sample cup used for the first time was subjected to thermal decomposition again without injecting a new compound thereinto. At this time, the sample cup was subjected to thermal decomposition for 30 seconds at a thermal decomposition temperature of 90° C., which is 10° C. higher. Also, after the thermal decomposition was completed, the sample cup was removed from the furnace so that it was not affected by the thermal decomposition temperature. In this manner, when the first sample was loaded into the sample cup and then thermally decomposed, the thermal decomposition experiment was performed while raising the temperature from 80° C., 90° C., and 100° C. to 320° C. in the end. As a result, it was possible to consider the thermal decomposition characteristics of compounds experienced as the thermal decomposition temperature increased by dividing them by temperature range. The results are shown in FIGS. 15 to 17.

[Decomposition Mechanism]

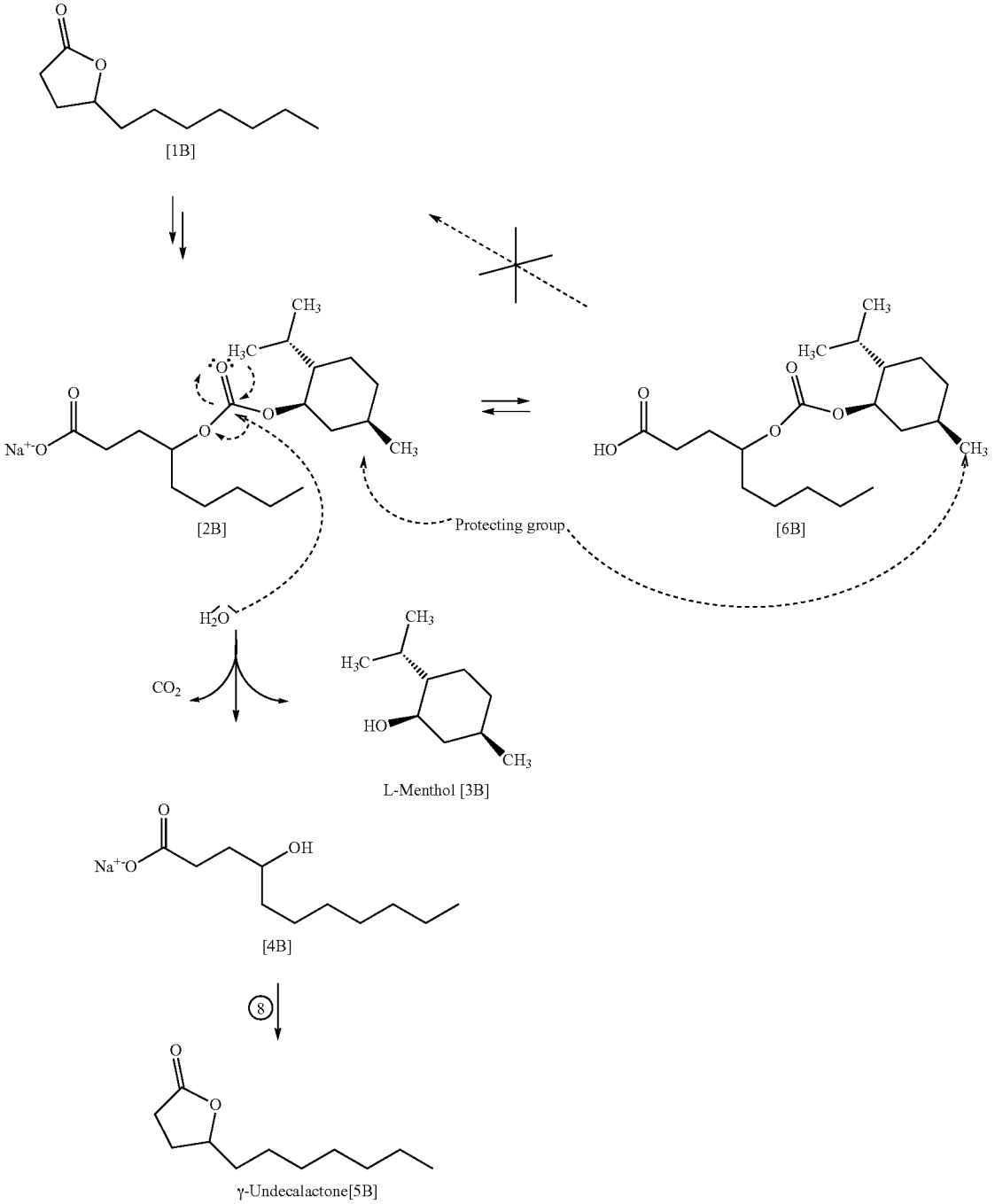

Figure 15:
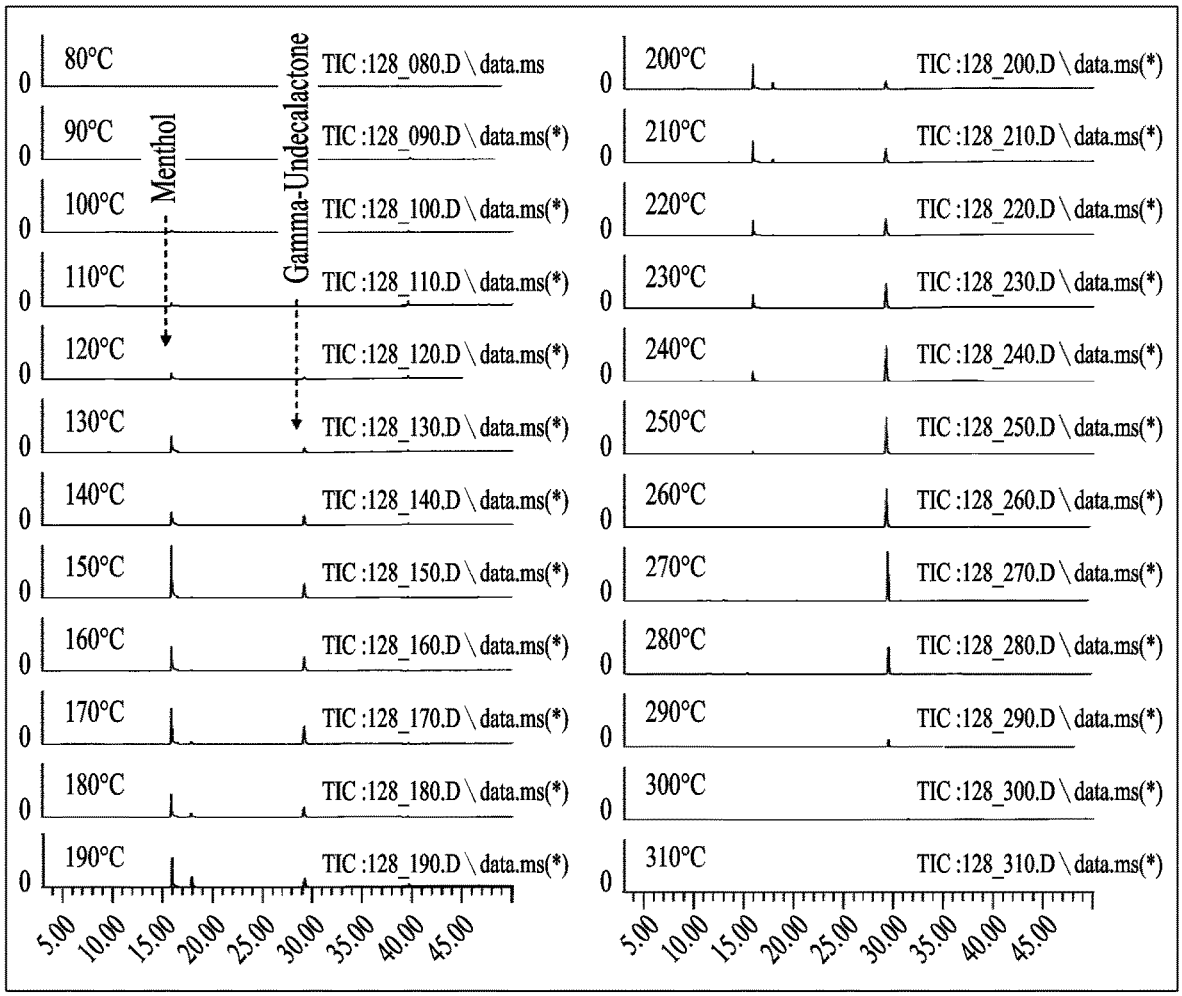
FIG. 15 is a diagram illustrating the results of thermal analysis of sodium (4-menthylcarbonyloxy)undecanoate (5d) prepared in an example according to one embodiment of the present disclosure.
Figure 16:
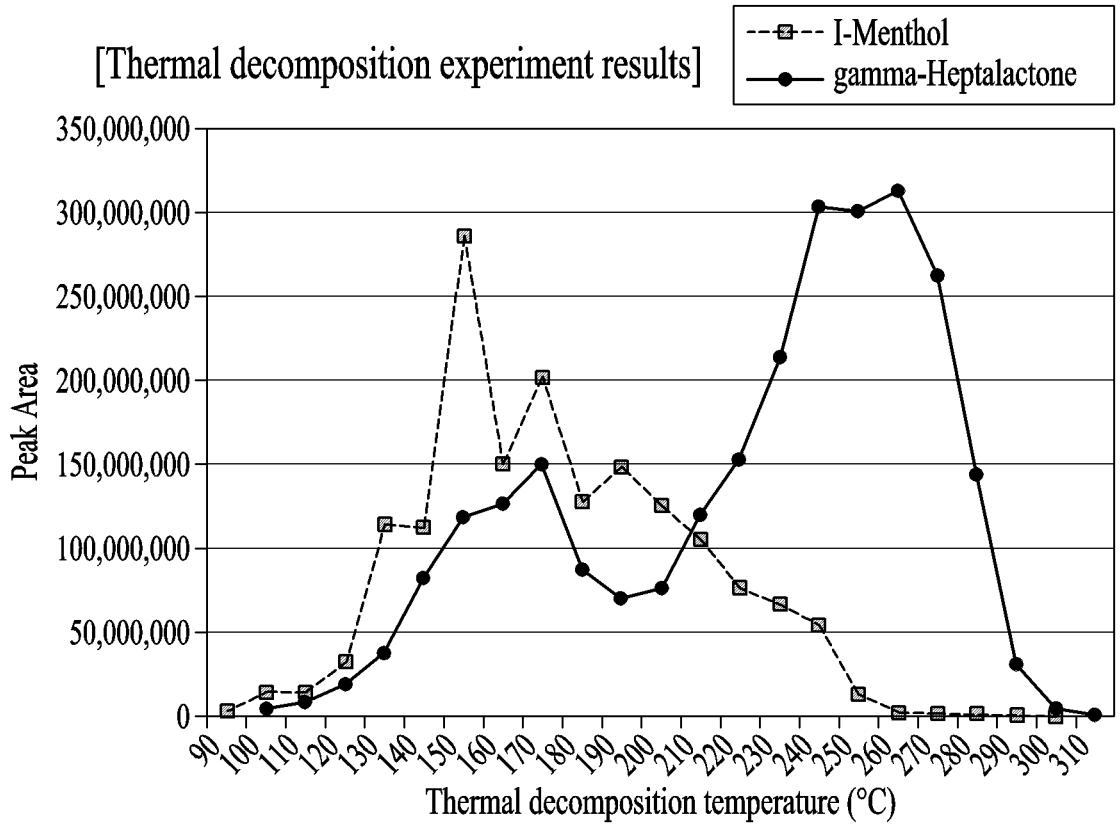
FIG. 16 is a diagram illustrating the distribution of components according to the thermal decomposition temperature of sodium (4-menthylcarbonyloxy)undecanoate (5d) prepared in an example according to one embodiment of the present disclosure.
Figure 17:
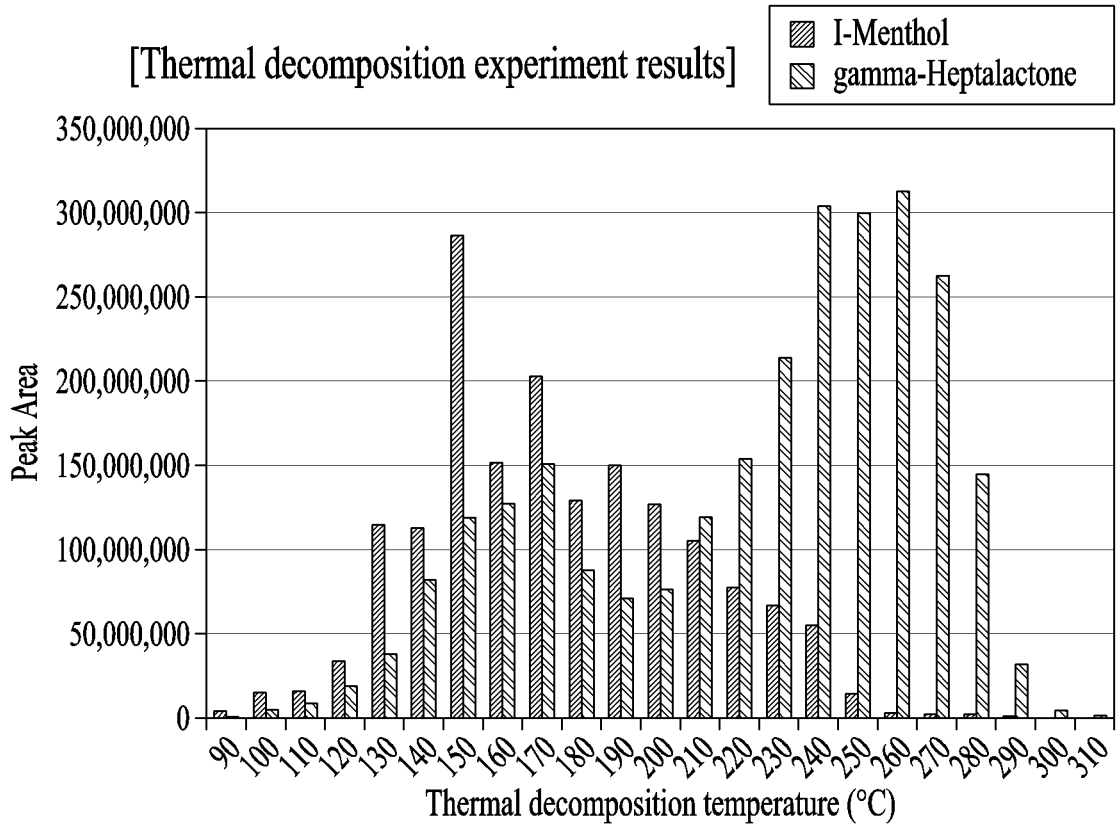
FIG. 17 is a diagram illustrating the distribution of components according to the thermal decomposition temperature of sodium (4-menthylcarbonyloxy)undecanoate (5d) prepared in an example according to one embodiment of the present disclosure.

In FIGS. 15 to 17, it may be confirmed that menthol and gamma-undecalactone are decomposed at a temperature of approximately 120° C. as a result of the thermal decomposition test of Compound [2B].

That is, lactone [1B, gamma-undecalactone] in the decomposition mechanism was ring-opened, and a hydroxyl group was covalently bonded with L-menthol through a carbonate linking group to prepare Compound [2B]. After Compound [2B] is applied to the product matrix, Compound [4B] with exposed hydroxyl groups is formed as L-menthol ([3B]) and $CO_2$ are being generated by heat. Compound [4B] is also subjected to ring-closing (intramolecular esterification) by heat to produce gamma-undecalactone [5B]. In the [2B] state, the hydroxyl group is protected with a menthyl carbonate group so that the occurrence of ring-closing (intramolecular esterification) may be suppressed at room temperature.

The compound according to the present disclosure expressing the flavor ingredients by being thermally decomposed is as follows. Looking at the thermal decomposition pattern of Compound [2B], menthol is thermally decomposed and expressed while it reaches a temperature from 120° C. to 260° C., and gamma-lactone is first expressed while it reaches a temperature from 120° C. to 200° C., and subsequently, secondary expression also becomes abundant while it reaches a temperature from 200° C. to 300° C. Perhaps, even if menthol, which is used as a protecting group, is deprotected by heat and expressed, it seems to exist for a while as a compound state in the form of [4B], that is, as an intermediate state. Eventually, lactone is produced by intramolecular esterification, but this ring-closing may be retarded in the salt form state. In addition, as a result of the thermal decomposition experiment, as the temperature increased, menthol was thermally decomposed and expressed, and when it is in the [4B] state of the salt form, intramolecular esterification occurred at a little higher temperature to produce lactone [5B]. In other words, it could be found that remaining ring-closing occurs in a high temperature range with a time difference from the temperature range where menthol is thermally decomposed.

Example 2

After mixing 0.01 to 5 wt % of a target product (synthesized sodium 5-(menthylcarbonyloxy)decanoate (5c) of Preparation Example, 95 to 99 wt % of a base substrate (pulp), and the balance of other additives, the mixture was prepared into a sheet (2 mm thick) using roll-to-roll and dried at room temperature. The sheet was sniffed at room temperature, but there was no smell of the flavoring compounds used in the synthesis of the target product. Next, the sheet was applied as cigarette paper for cigarette tobacco to make a common cigarette, and the cigarette was smoked, and it was confirmed that flavors (e.g., lactone flavor and menthol flavor used in synthesizing the target product) were expressed during smoking.

Example 3

After 0.003 to 0.02 wt % of a target product of Preparation Example (synthesized sodium (4-menthylcarbonyloxy)undecanoate) (5d), 90 to 99 wt % of tobacco powder with an average particle size of about 0.03 mm to about 0.12 mm, and the balance of other additives were mixed, a tobacco composition was prepared in the usual manner. After applying the tobacco composition as a smoking medium and wrapping it in cigarette paper, a filter and a wrapping paper were made up to prepare a usual cigarette tobacco. Cigarette tobacco was smoked, and it was confirmed that flavors were expressed during smoking in mainstream smoke and sidestream smoke.

Example 4

Figure 19:
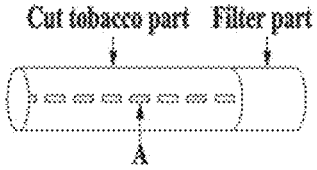
FIG. 19 is a diagram illustrating a table showing the amount of flavoring agent applied according to the flavoring agent application site in an example according to one embodiment of the present disclosure.
Figure 19:
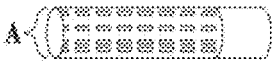
Figure 19:
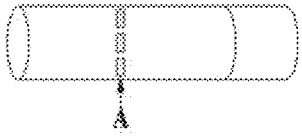
Figure 19:
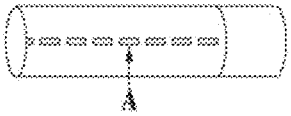
Figure 19:
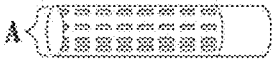
Figure 19:
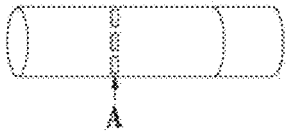
Figure 19:
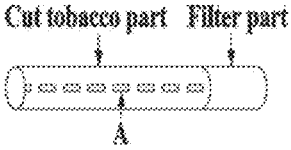
Figure 19:
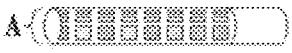
Figure 19:
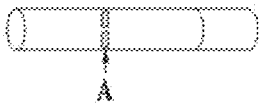
Figure 19:
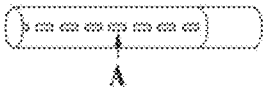
Figure 19:
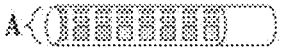
Figure 19:
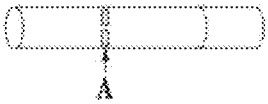

An ink composition was prepared by mixing a target product of Preparation Example (synthesized sodium (4-menthylcarbonyloxy)undecanoate, 5d) and a solvent (water and ethanol). In the ink composition, a single or a plurality of dotted lines having a line thickness of 0.1 mm to 1 mm were printed on one surface of cigarette paper of a cut tobacco part by a stamp method. In each sample, the amount of composition for application of a synthetic flavoring is shown in grams per 100 kg of cut tobacco. As shown in FIG. 19, different effects may be given depending on the application site when applied to cigarette paper, and the synthetic flavoring was applied to various parts depending on the cigarette rod.

Example 5

Figure 20:
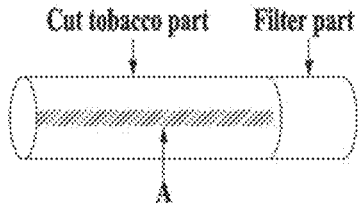
FIG. 20 is a diagram illustrating a table showing the amount of γ-undecalactone expressed during thermal decomposition according to the flavoring agent application site in an example according to one embodiment of the present disclosure.
Figure 20:
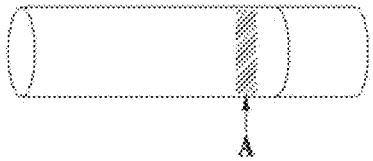

In the same manner as in Example 4, the ink composition (applying Compound 5d) was applied to various parts of the cigarette paper to evaluate the effects of the sidestream smoke improving synthetic flavoring cigarette products depending on the application sites, as shown in FIG. 20.

Sample 5-1 is 2.56 g of γ-undecalactone/100 kg of cut tobacco, which is expressed when thermally decomposed, and may be evaluated as follows.

Appearance: No difference from control (no smell). Mainstream smoke: Although the lactone odor is not expressed significantly, it is at a level that is felt weakly, and there is no significant difference from the user's point of view, and it gives a soft feel.

Sidestream smoke: The acridness of the sidestream smoke from Control cigarettes was slightly reduced, but there was no significant difference, and it may give a weak feeling from the user's point of view.

Sample 5-2 is 12.51 g of γ-undecalactone/100 kg of cut tobacco, which is expressed when thermally decomposed, and may be evaluated as follows.

Appearance: No difference from control (no smell).

Mainstream smoke: During smoking, the lactone scent rises subtly, and the closer you get to the applied part (band shape), the stronger the lactone scent. During the combustion of the applied part, the expression of the fragrance increases, and a disgusting and greasy feeling is reduced.

Sidestream smoke: A lot of fragrance is expressed at the application site, and there is a feeling that the fragrance is excessive, but it is not negative. It is better to change the position of the application site to give the feeling of change more quickly by moving the position of the application site from the end to the middle part. A lot of fragrance of sidestream smoke is expressed positively, and it gives a feeling that there is some effect of reducing hand odor.

Example 6

In the same manner as in Example 4, the ink composition (applying Compound 6d) was applied to various parts of the cigarette paper to evaluate the effects of the sidestream smoke improving synthetic flavoring cigarette products depending on the application sites. The application sites of the sidestream smoke improving synthetic flavoring cigarette products are shown in FIG. 21.

In the present disclosure, when burning a cigarette by applying a novel compound, in which flavor ingredients are expressed during thermal decomposition, to cigarette paper of traditional cigarette tobacco, flavor ingredients (e.g., lactones or menthol) are expressed by heat during tobacco combustion, particularly during smoldering, so that the effect of relieving the acrid smell of sidestream smoke may be provided. In addition, the novel compound may be applied to a medium of traditional cigarette tobacco, for example, cigarette cut tobacco, to improve fragrance retention.

When the present disclosure is applied to a medium of a heating-type cigarette stick, next generation product (NGP), it may be possible to impart taste persistence of the flavor ingredients. In other words, in heating-type cigarettes, since the flavor ingredients contained in the medium are exhausted in the initial puff by static heating, but the synthetic compound, which expresses flavor ingredients during thermal decomposition, is expressed only when it is decomposed by heat, the flavor ingredients are generated even in the last puff even if the puff continues so that the cigarette taste may be maintained constant.

Although the embodiments have been described with reference to the limited examples and drawings as described above, various modifications and variations are possible from the above description by one of ordinary skill in the art. For example, appropriate results may be achieved although described techniques are performed in order different from a described method, and/or described elements are joined or combined in a form different from the described method, or replaced or substituted by other elements or equivalents. Therefore, other implementations, other embodiments, and equivalents to the scope of claims also belong to the scope of the claims to be described later.

The invention claimed is:

1. A smoking article, comprising:

a flavoring agent which is a compound represented by the following Formula 1:

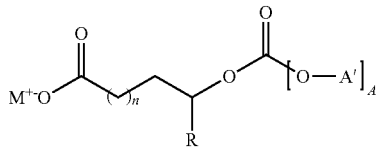

(In Formula 1, n is an integer of 1 or 2, M is selected from alkali metals and transition metals, R is a straight-chain or branched-chain alkyl group having 1 to 30 carbon atoms, and moiety A is a moiety derived from a flavoring compound having at least one of an aromatic ring, an aliphatic ring, and an aliphatic chain which have a hydroxyl group, wherein the hydroxyl group participates in a carbonate linking group

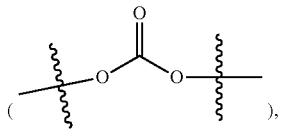

and A' corresponds to a flavoring compound except for the hydroxyl group).

2. The smoking article of claim 1, wherein the flavoring compound is selected from a cyclic monoterpene-based compound having a hydroxyl group, a monoterpene-based acyclic compound having a hydroxyl group, a $C_6$-$C_{10}$ aromatic compound having a hydroxyl group, and a $C_5$-$C_6$ non-aromatic ring having a hydroxyl group.

3. The smoking article of claim 1, wherein the flavoring compound is selected from the following formulas:

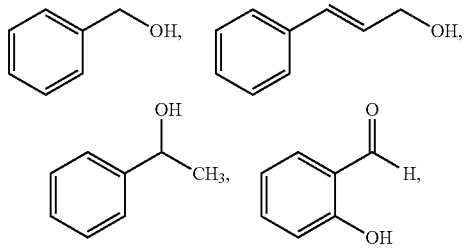

-continued

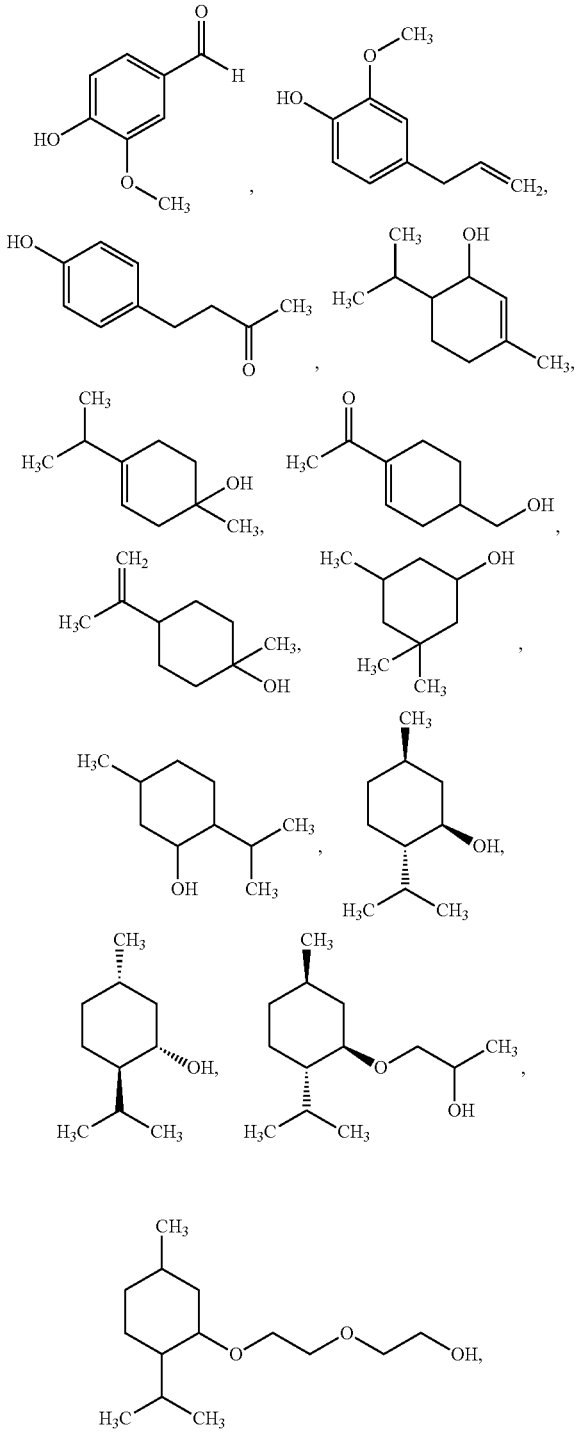

-continued
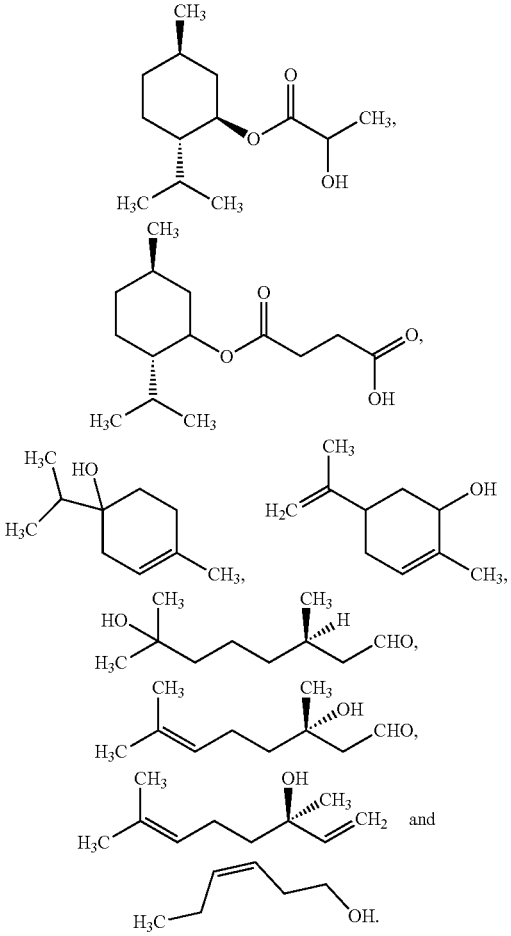
4. The smoking article of claim 1, wherein the A' is selected from the following formulas:
(* is the binding site of oxygen in the carbonate.)
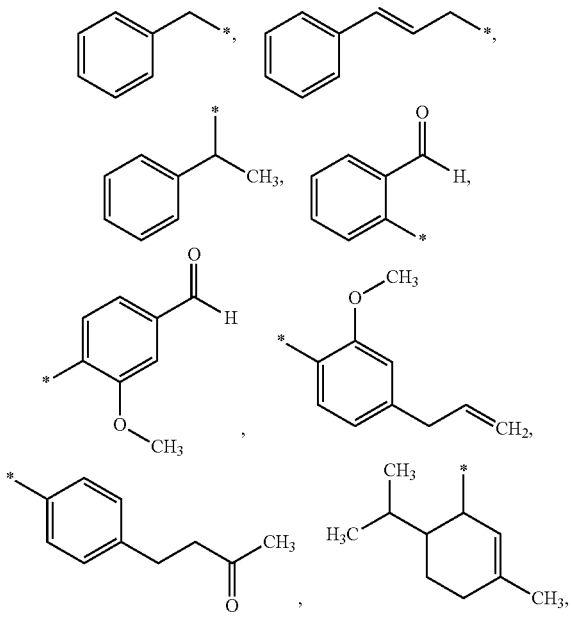
-continued
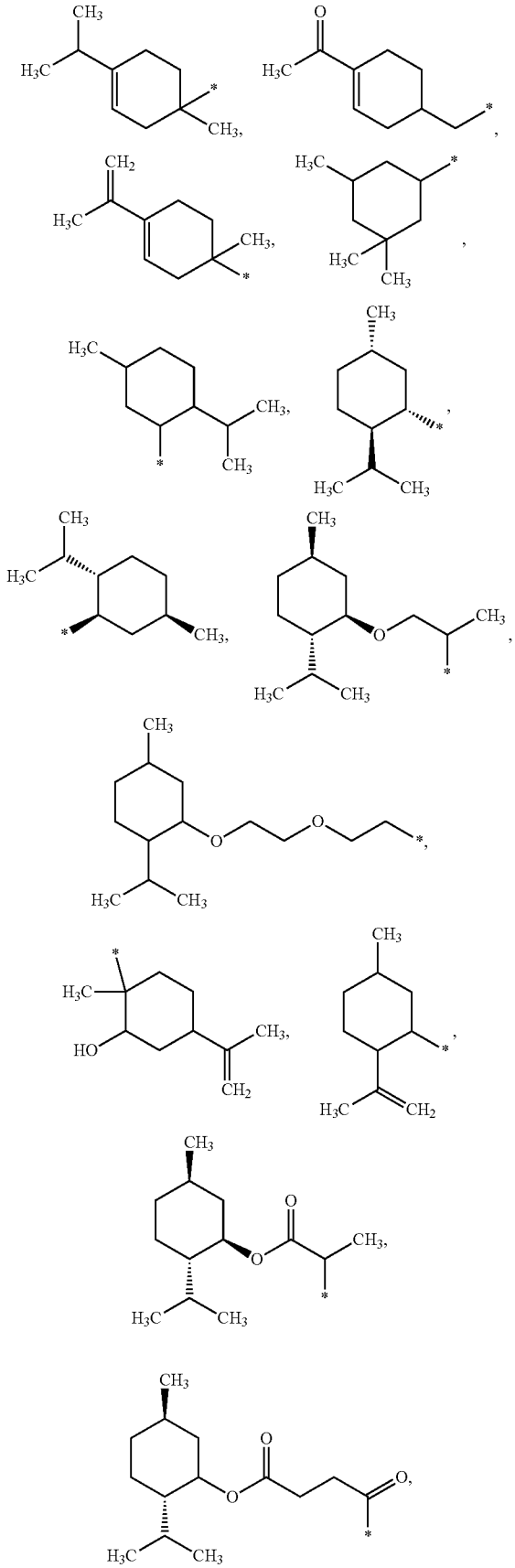

-continued

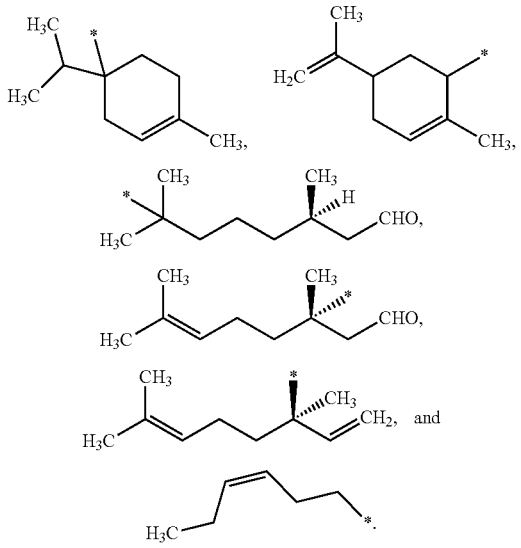

5. The smoking article of claim 1, wherein the transition metal is selected from Zr, Mg, Ca, Co, Rh, Ir, Nb, Pd, Pt, Fe, Ru, Os, Cr, Mo, W, Mn, Tc, Re, Cu, Ag, and Au, and the alkali metal is selected from Li, Na, K, Rb, and Cs.

6. The smoking article of claim 1, wherein the compound is selected from the following Formulas 1-1 to 1-26:

[Formula 1-1]

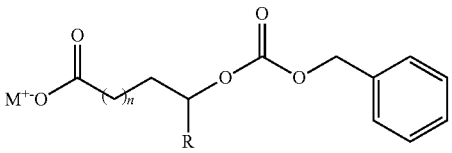

[Formula 1-2]

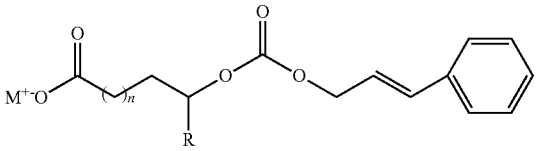

[Formula 1-3]

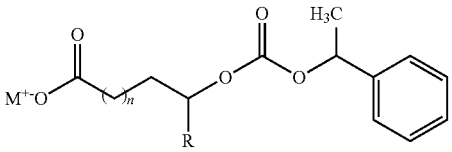

[Formula 1-4]

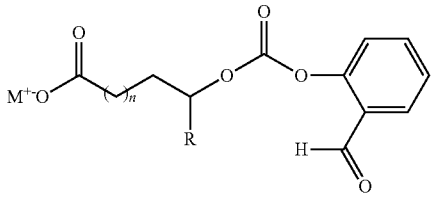

-continued

[Formula 1-5]

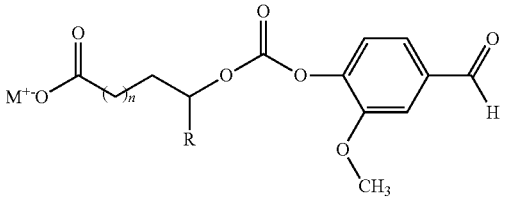

[Formula 1-6]

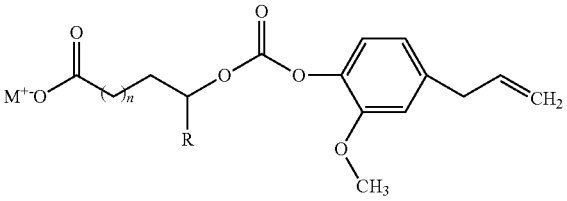

[Formula 1-7]

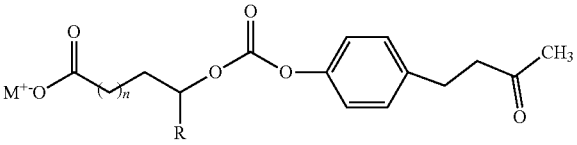

[Formula 1-8]

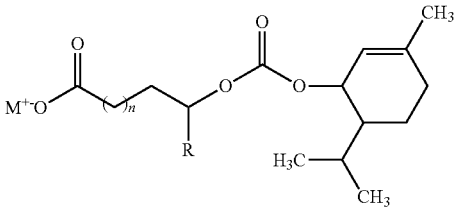

[Formula 1-9]

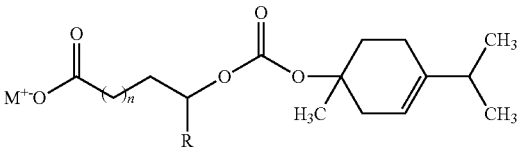

[Formula 1-10]

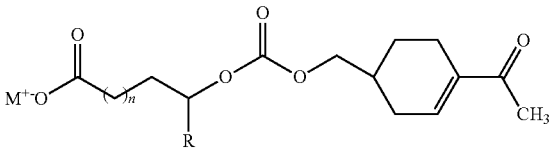

[Formula 1-11]

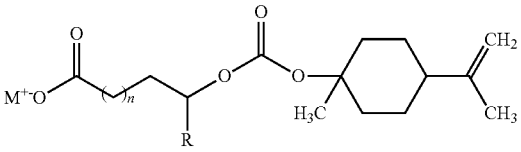

[Formula 1-12]

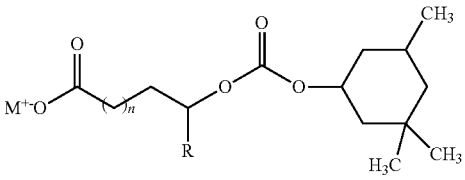

-continued

[Formula 1-13]

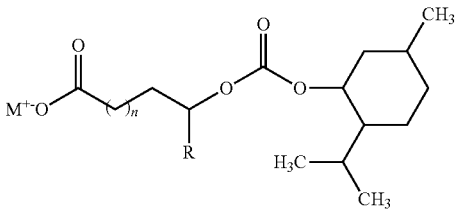

[Formula 1-14]

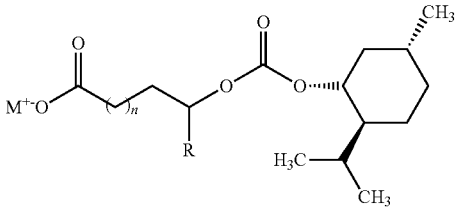

[Formula 1-15]

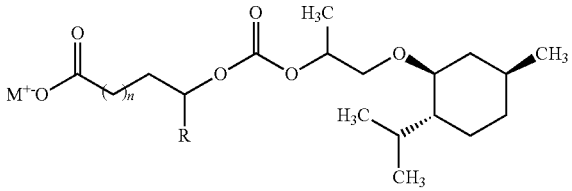

[Formula 1-16]

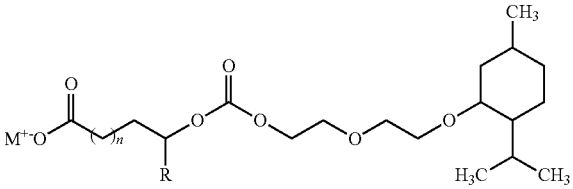

[Formula 1-17]

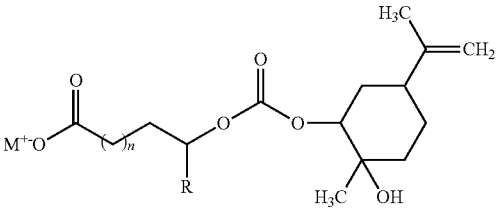

[Formula 1-18]

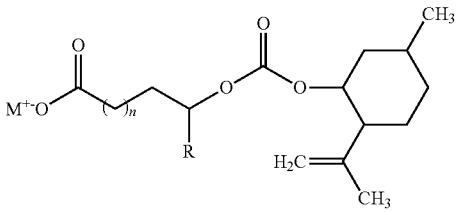

[Formula 1-19]

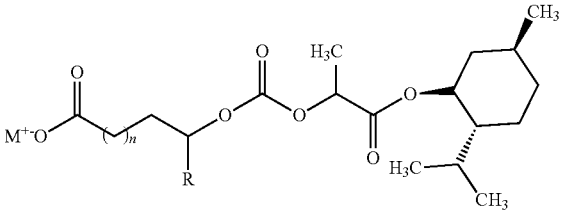

-continued

[Formula 1-20]

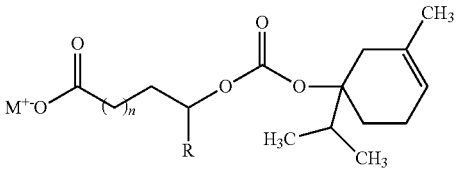

[Formula 1-21]

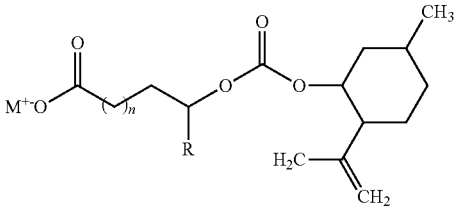

[Formula 1-22]

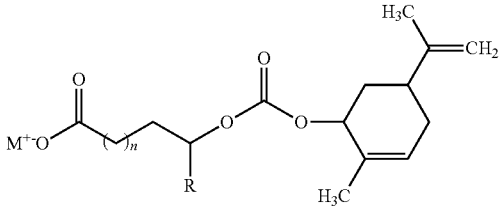

[Formula 1-23]

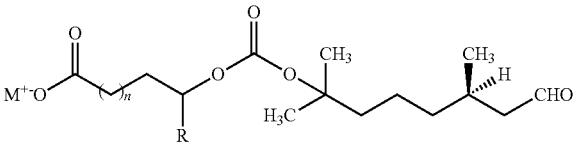

[Formula 1-24]

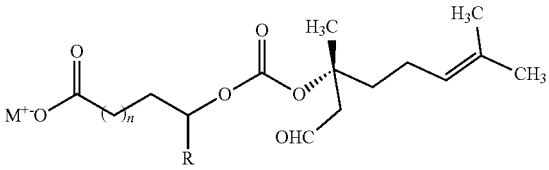

[Formula 1-25]

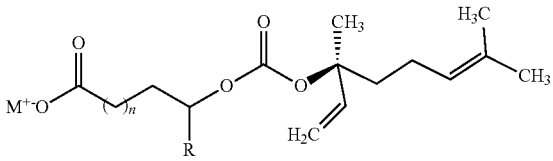

[Formula 1-26]

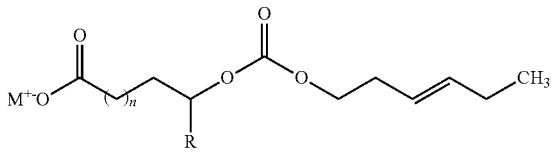

(Here, M and R are as defined in Formula 1 above).

7. The smoking article of claim 1, wherein the flavoring agent is a flavoring agent compound that expresses flavor upon thermal decomposition.

8. The smoking article of claim 1, wherein the flavoring agent is decomposed into the flavoring compound, a lactone compound, and carbon dioxide during thermal decomposition.

9. The smoking article of claim 1, wherein the compound is thermally decomposed at a temperature of 80° C. or higher.

10. The smoking article of claim 8, wherein the lactone compound is gamma lactone of the following Formula 2 or delta lactone of the following Formula 3:

[Formula 2]

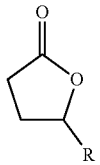

[Formula 3]

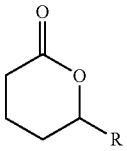

(Here, R is a straight-chain or branched-chain alkyl group having 1 to 30 carbon atoms).

11. The smoking article of claim 8, wherein the lactone compound is selected from the following formulas:

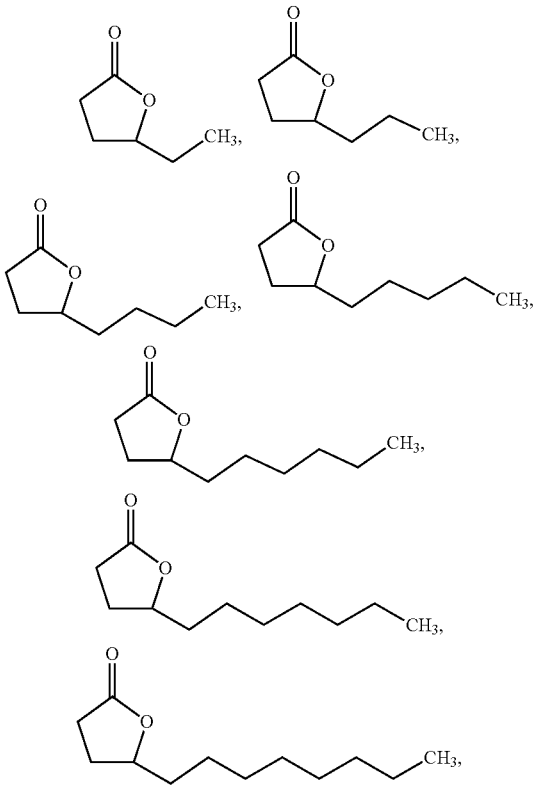

-continued

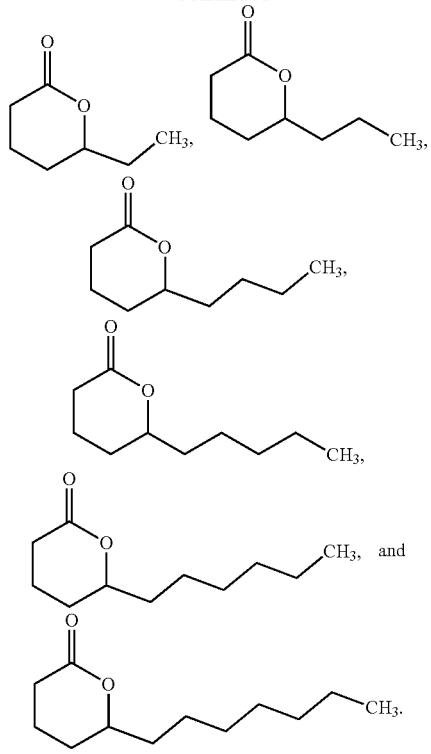

12. The smoking article of claim 1, wherein the smoking article comprises a slurry, a paste, a liquid phase, a gel, a powder, beads, a sheet, a film, a fiber or a molded body containing the compound represented by Formula 1 above.

13. The smoking article of claim 1, wherein the smoking article comprises at least one of sheets, films, and filters locally printed or coated on the entire surface or at least a portion of the compound represented by Formula 1 above.

14. The smoking article of claim 1, wherein the compound represented by Formula 1 above is printed in a pattern along the axial direction, the transverse direction or both thereof of the smoking article rod, and the pattern is one in which at least one form of a straight line, a dotted line, a lattice, a polygon, a dot, a circle, and an ellipse is arranged.

15. The smoking article of claim 1, wherein the compound represented by Formula 1 is contained in an amount of 0.0001 parts by weight or more based on 100 parts by weight of the smoking medium.

16. The smoking article of claim 1, wherein the smoking article comprises a filter part and a smoking medium part, and the smoking medium part comprises cigarette paper, smoking medium, or both thereof, containing the compound represented by Formula 1 above.

17. The smoking article of claim 16, wherein the cigarette paper comprises a pattern region of the compound represented by Formula 1 above distributed on the entire surface of at least one surface thereof or locally based on the axial direction, the transverse direction, or both thereof of the cigarette rod, and the cigarette taste contained in sidestream smoke is controlled depending on the location of the pattern region.

* * * * *